US008551680B2

(12) United States Patent
Ayaki et al.

(10) Patent No.: US 8,551,680 B2
(45) Date of Patent: Oct. 8, 2013

(54) TONER

(75) Inventors: Yasukazu Ayaki, Yokohama (JP); Atsushi Tani, Suntou-gun (JP); Tsuneyoshi Tominaga, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/419,409

(22) Filed: Mar. 13, 2012

(65) Prior Publication Data

US 2012/0171607 A1 Jul. 5, 2012

Related U.S. Application Data

(60) Division of application No. 12/511,641, filed on Jul. 29, 2009, now abandoned, which is a continuation of application No. PCT/JP2009/053803, filed on Feb. 24, 2009.

(30) Foreign Application Priority Data

Feb. 25, 2008 (JP) ..... 2008-042970

(51) Int. Cl.
*G03G 9/093* (2006.01)

(52) U.S. Cl.
USPC ..... 430/137.14

(58) Field of Classification Search
USPC ..... 430/137.14
See application file for complete search history.

(56) References Cited

U.S. PATENT DOCUMENTS

| | | | |
|---|---|---|---|
| 4,797,344 | A | 1/1989 | Nakahara et al. |
| 4,837,107 | A | 6/1989 | Axelsson et al. |
| 4,954,412 | A | 9/1990 | Breton et al. |
| 5,567,567 | A | 10/1996 | Akiyama et al. |
| 5,948,584 | A | 9/1999 | Hashimoto et al. |
| 6,337,169 | B1 | 1/2002 | Hashimoto et al. |
| 6,562,535 | B1 | 5/2003 | Masuo et al. |
| 7,049,039 | B2 | 5/2006 | Tazawa et al. |
| 7,250,241 | B2 | 7/2007 | Ayaki et al. |
| 2004/0110081 | A1 | 6/2004 | Tanaka et al. |

(Continued)

FOREIGN PATENT DOCUMENTS

| | | | |
|---|---|---|---|
| EP | 0 587 036 | A2 | 9/1993 |
| EP | 0 672 957 | A2 | 9/1995 |

(Continued)

OTHER PUBLICATIONS

Korean Office Action dated Feb. 29, 2012 in Korean Application No. 10-2010-7020420.

(Continued)

*Primary Examiner* — Hoa V Le
(74) *Attorney, Agent, or Firm* — Fitzpatrick, Cella, Harper and Scinto

(57) ABSTRACT

Toner characterized in that assuming that the glass transition point of the toner measured by a differential scanning calorimeter (DSC) is represented by $T_1$(° C.), in a micro compression test at $T_1-10$ (° C.), when a load from 0.00N (0.00 mgf) to $7.85\times10^{-4}$ N (80.00 mgf) is applied at the intervals of $7.85\times10^{-7}$ N (0.08 mgf) to a single particle of the toner, the strain value $A_{80a}$(%) at $7.85\times10^{-4}$ N is 35.0 to 75.0%; and in a load (x-axis)-strain (y-axis) curve obtained by the micro compression test, the ratio of an area ($S_{1a}$) of a specific region, relative to an area ($S_{2a}$) of a specific region, ($S_{1a}/S_{2a}$), is 1.5 to 3.5.

10 Claims, 2 Drawing Sheets

(56) References Cited

U.S. PATENT DOCUMENTS

| | | | | |
|---|---|---|---|---|
| 2005/0042535 | A1* | 2/2005 | Vanbesien et al. | 430/110.3 |
| 2005/0074685 | A1* | 4/2005 | Kido et al. | 430/110.2 |
| 2005/0100809 | A1 | 5/2005 | Fujino et al. | |
| 2006/0057488 | A1 | 3/2006 | Inoue et al. | |
| 2006/0204882 | A1 | 9/2006 | Nozaki et al. | |
| 2006/0216628 | A1 | 9/2006 | Nakamura et al. | |
| 2007/0048647 | A1 | 3/2007 | Daimon et al. | |
| 2007/0117945 | A1 | 5/2007 | Minami et al. | |
| 2007/0154831 | A1 | 7/2007 | Cheong et al. | |
| 2007/0275317 | A1 | 11/2007 | Fujimoto et al. | |
| 2008/0003512 | A1 | 1/2008 | Kobayashi et al. | |
| 2008/0057434 | A1 | 3/2008 | Itoh | |
| 2008/0096120 | A1 | 4/2008 | Yamaguchi et al. | |
| 2009/0011356 | A1 | 1/2009 | Tomita et al. | |
| 2009/0233203 | A1* | 9/2009 | Yuasa et al. | 430/108.4 |
| 2009/0291380 | A1 | 11/2009 | Ayaki et al. | |
| 2009/0291383 | A1* | 11/2009 | Ayaki et al. | 430/110.2 |

FOREIGN PATENT DOCUMENTS

| | | |
|---|---|---|
| EP | 0 743 564 A2 | 11/1996 |
| JP | 06-130713 | 5/1994 |
| JP | 09-043896 | 2/1997 |
| JP | 2003-091093 | 3/2003 |
| JP | 2004-226572 | 8/2004 |
| JP | 2005-099085 | 4/2005 |
| JP | 2005-266383 | 9/2005 |
| JP | 2005-275146 | 10/2005 |
| JP | 2005-300937 | 10/2005 |
| JP | 2006-084743 | 3/2006 |
| JP | 2006-084952 | 3/2006 |
| JP | 2006-267950 | 10/2006 |
| JP | 2007-003694 | 1/2007 |
| JP | 2007-025525 | 2/2007 |
| JP | 2007-279652 | 10/2007 |

OTHER PUBLICATIONS

Notification of Transmittal of Translation of IPRP, Oct. 14, 2010, 12 pages.

Chinese Office Action dated Jan. 11, 2012 in Chinese Application No. 200980106355.6.

European Search Report dated Sep. 3, 2012 in European Application No. 09714641.9.

* cited by examiner

TONER

This application is a divisional of U.S. application Ser. No. 12/511,641 filed on Jul. 29, 2009, which is a continuation of International Application No. PCT/JP2009/053803 filed on Feb. 24, 2009, which claims the benefit of Japanese Patent Application No. 2008-042970 filed on Aug. 25, 2008.

BACKGROUND OF THE INVENTION

1. Field of the Invention

The present invention relates to a toner for use in an electrophotographic method, an electrostatic recording method, a magnetic recording method and a toner-jet method.

2. Description of the Related Art

Conventionally, in the electrophotographic method, an electrostatic charge image is formed on a photosensitive member by various means and subsequently the electrostatic charge image is developed by use of a toner to form a toner image on the photosensitive member. The toner image is, if necessary, transferred onto a transfer material such as paper. Thereafter, the toner image is fixed on the transfer material by applying, e.g., heat, pressure, heat/pressure or a vaporized solvent to obtain an image.

As a process for fixing a toner image, for example, a heat pressurizing method by a heat roller (hereinafter referred to as a heat roller fixing method) and a heat fixing method for fixing an image while bringing a sheet onto which the image is to be fixed into contact with a heating body with a fixing film interposed between them (hereinafter referred to as a film fixing method) have been developed.

In the heat roller fixing method and the film fixing method, a toner image on the sheet onto which the toner image is to be fixed is moved on the surface of the heat roller or the fixing film while keeping the toner image in contact therewith under pressure by a pressurizing member provided in contact therewith. In the fixing method, since the surface of the heat roller or the fixing film is in contact with the toner image of the sheet onto which the toner image is to be fixed under pressure, the thermal efficiency for fixing the toner image onto the sheet by fusion is extremely high, with the result that fixation can be quickly and satisfactorily performed. Particularly, the film fixing method has a large effect upon energy-saving. In addition, another effect is expected. For example, time required from the power-on time of an electrophotographic apparatus until the first print is completed can be reduced.

Various requests have been made for the electrophotographic apparatus, including the formation of a high-quality image, reduction in size/weight, high-speed operation with a high productivity and energy saving. Of them, particularly in a fixing process, it has been important, as technical problems, to achieve a further high-speed operation, reduce more energy and develop a system and material capable of attaining a highly reliable operation. However, to solve these problems by the heat roller fixing method and the film fixing method, it is essential to improve particularly the fixing performance of toner to a large extent. More specifically, the fixing performance for fixing a toner image to a sheet (onto which the toner image is to be fixed) sufficiently at a further lower temperature (hereinafter referred to as low-temperature fixing performance) must be improved. However, when an improvement of the low-temperature fixing performance is attempted, the performance of suppressing aggregation and fusion phenomena of toner during a long storage time (hereinafter referred to as anti-blocking performance) and the performance of suppressing formation of defective images when a large number of prints are continuously made (hereinafter referred to as running stability performance) tend to decrease. Therefore, it has been desired to develop a toner satisfying all of these performances. Furthermore, it is also necessary to improve a performance of preventing offset, which is a phenomenon where a next transfer material is stained with a toner undesirably deposited onto a fixing member such as a roller or a film (hereinafter referred to as anti-offset performance). Moreover, with the spread of full-color electrophotographic apparatuses, a new request for improving image quality has been made. To be more specific, a performance of improving a color development by forming a highly glossy image (hereinafter referred to as glossing performance) and a performance of suppressing unevenness of gloss in an image (hereinafter referred to anti-soaking performance) are required. The anti-soaking performance tends to emerge as deterioration of image quality. This is caused when the first half (in the moving direction thereof) of a transfer material such as paper is heated unevenly from the second half or when the first paper sheet is heated unevenly from the tenth paper sheet by increasing a discharge speed.

As the toner used for heat and pressure fixation and attempted to have well-balanced, low-temperature fixing performance and anti-blocking performance, a toner having a capsule structure is known (see Japanese Patent Application Laid-Open Nos. H06-130713 and H09-043896). These toners have an inner nuclear layer having a low glass transition point (Tg) covered with an outer shell layer having a high Tg. In this way, the low-Tg material contained in the interior of a toner particle is prevented from bleeding out, thereby providing low-temperature fixing performance and anti-blocking performance or running stability performance in a balanced manner. Furthermore, a toner having a cover layer of resin microparticles has good fixing performance, anti-blocking performance and running stability performance (see Japanese Patent Application Laid-Open Nos. 2003-091093 and 2004-226572). In another approach for improving the low-temperature fixing performance of a toner, there is provide a toner which has a controlled change of thermal physical property before and after the fusion of toner (see Japanese Patent Application Laid-Open No. 2006-084743). According to this toner, the low-temperature fixing performance and anti-blocking performance can be simultaneously achieved. However, it is difficult for these toners to satisfy all performances mentioned above when the low-temperature fixing performance is further improved.

SUMMARY OF THE INVENTION

An object of the present invention is to provide a toner capable of overcoming the problems as mentioned above. More specifically, an object of the present invention is to provide a toner containing wax and having good running stability performance even if the low-temperature fixing performance is improved and capable of forming a high-grade image.

The present invention relates to a toner comprising toner particles containing at least a binder resin, a colorant and wax, and inorganic fine powder, in which, assuming that the glass transition point of the toner measured by differential scanning calorimeter (DSC) is represented by $T_1$(° C.), in a micro compression test for the toner at $T_1-10$ (° C.), when a load from 0.00N (0.00 mgf) to $7.85\times10^{-4}$ N (80.00 mgf) is applied at the intervals of $7.85\times10^{-7}$ N (0.08 mgf) to a single particle of the toner, the strain value $A_{80a}$(%) at $7.85\times10^{-4}$ N is 35.0 to 75.0%; and in a load (x-axis)-strain (y-axis) curve obtained by the micro compression test, the ratio of the area ($S_{1a}$) of the region, which is surrounded by the curve, the linear line of $x=7.85\times10^{-4}$ N and the x-axis, relative to the area ($S_{2a}$) of the region, which is surrounded by the linear line connecting the point on the curve at $x=3.92\times10^{-5}$ N (4.00 mgf) to the point of the curve at $x=7.85\times10^{-5}$ N (800 mgf), and the linear line of $x=7.85\times10^{-4}$ N, the x-axis, that is, the ratio ($S_{1a}/S_{2a}$) is 1.5 to 3.5.

According to the present invention, there is provided a toner containing a binder resin, a colorant and wax, which toner can exhibit good running stability performance even if the low-temperature fixing performance is improved and can form high-grade images.

Further features of the present invention will become apparent from the following description of exemplary embodiments with reference to the attached drawings.

DESCRIPTION OF THE EMBODIMENTS

Figure 1:
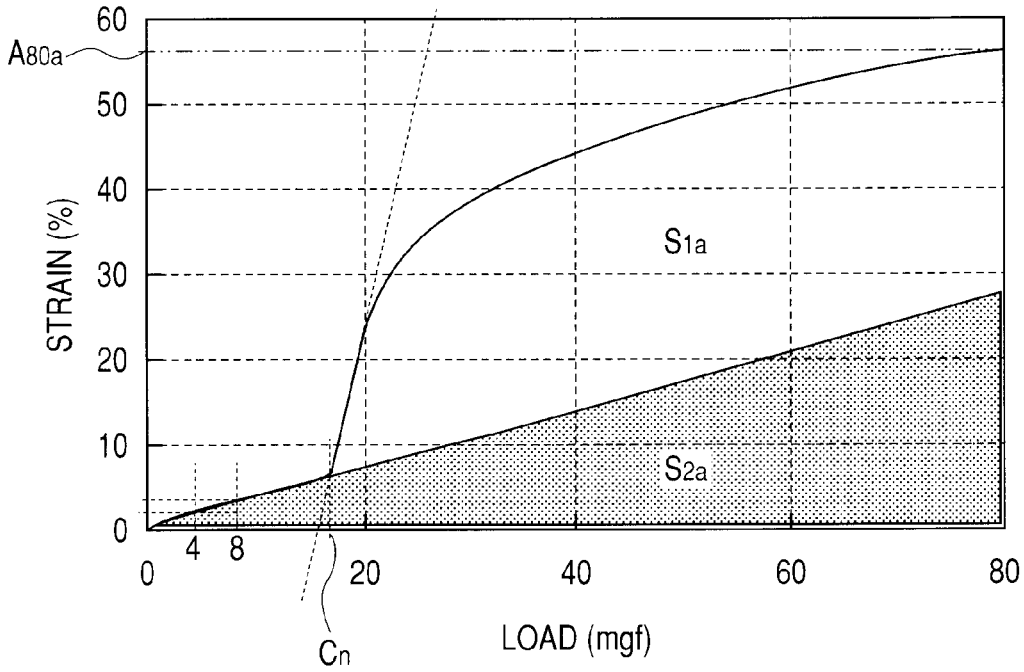
FIG. 1 is a graph showing a curve of load (x-axis) and strain (y-axis) of toner.

The micro compression test of a toner in the present invention will be described. As an apparatus for use in the micro compression test of the present invention to perform measurement, an apparatus satisfying the following conditions can be used. As an indenter for applying load to a toner, an indenter having a sufficiently high hardness compared to the toner and having a tip portion, which has a flat surface having a surface roughness Rz of 0.1 μm or less and an inscribed circle of not less than 15.0 μm in diameter, can be used.

Measurable range of load: not less than $9.81\times10^{-4}$N (100.00 mgf)

Measurable resolution of displacement: not more than 1.0 nm

Measurable range of displacement: not less than 10.0 μm

Measurement is performed as follows. The indenter is brought into contact with a single toner particle. A load is applied from 0.00N (0.00 mgf) to $7.85\times10^{-4}$ N (80.00 mgf) at the intervals of $7.85\times10^{-7}$ N (0.08 mgf) to the toner particle every 30 msec. The displacement (μm) of the indenter is measured at every application of load. In the actual measurement of a single toner particle, the toner particle size or diameter is determined by measuring the length and breadth of the toner particle and averaged. The average value is used as the particle size R (μm) of the toner [R=(length+breadth)/2]. Assuming that the shape of a toner particle is a true sphere having a particle size R (μm), the displacement x (μm) of the indenter to each load is obtained as a percentage of strain to R [strain A (%)=x×100/R]. Based on this, a load (x-axis)-strain (y-axis) curve of a single toner particle is prepared. From the load-strain curve, the physical properties of the single toner particle are read off. The same measurement is performed with respect to 50 toner particles. Average values of the physical properties are separately obtained and employed as the physical property values defined in the present invention.

To describe more specifically, measurement can be performed by using an ultra-micro indentation hardness analyzer (ENT-1100a; manufactured by Elionix Co., Ltd) in accordance with the following measurement method. The apparatus is set under the environment of a temperature of 22 C and a humidity of 60% RH. The indenter to be used is a planar indenter having a tip portion of a 20 μm×20 μm square. The conditions of parameters are set as follows:

Movement average point: 1

Speed of an indenter at the surface detection time: 100

Indenter speed drop coefficient during the surface detection time: 2

Magnification of objective lens: 40

Number of steps of the surface detection: 20

Number of divisions in a load-loading test: 1,000

Interval between steps in the load-loading test: 30 msec

Test load: $7.85\times10^{-4}$ N (80.00 mgf)

Measurement is performed as follows. A toner is applied onto a plate equipped with a temperature controller such that individual toner particles are not in contact with each other as much as possible on the plate. The plate is set on the apparatus. Measurement is performed by selecting 50 discrete toner particles at random from toner particles existing as a single particle.

In the present invention, the strain $A_{80a}$(%) at a load of $7.85\times10^{-4}$ N (80.00 mgf) is an average value of strain that is determined from load (x-axis)-strain (y-axis) curves made based on the aforementioned measurement of arbitrarily chosen 50 toner particles.

In the load (x-axis)-strain (y-axis) curve with respect to a certain single toner particle, the area of a region surrounded by the curve, a linear line of $x=7.85\times10^{-4}$ N and the x-axis is represented by $s_{1a}$. Furthermore, the area of a region surrounded by a linear line connecting a point on the curve at a load of $3.92\times10^{-5}$ N (4.00 mgf) to a point on the curve at a load of $7.85\times10^{-5}$ N (8.00 mgf), a linear line of $x=7.85\times10^{-4}$ N and the x-axis is represented by $s_{2a}$. The ratio of $s_{1a}$ and $s_{za}$, ($s_{1a}/s_{2a}$), is obtained for the 50 toner particles selected above and average values thereof, $S_{1a}$ and $S_{2a}$, are calculated. Based on these values, ($S_{1a}/S_{2a}$) is obtained by calculation. Note that the measurement is performed under the condition of measuring temperature: a glass transition point T1 of the toner −10 (° C.).

A single particle of a toner (Toner 1 of Example 1) of the present invention is subjected to the micro compression test mentioned above to prepare a load-strain curve, which is shown in FIG. 1.

Next, $B_{10}$, $B_{08}$, $B_{12}$, ϕ and α of the present invention will be described. In the measurement above, the particle sizes Rn (μm) of a single particle of the n-th toner particles are classified into groups set at intervals of 0.250 μm, for example, a group of not less than 5.000 μm to less than 5.250 μm, a group of not less than 5.250 μm to less than 5.500 μm, a group of not less than 5.500 μm to less than 5.750 μm and a group of not less than 5.750 μm to less than 6.000 μm. An average value $a_{80}$(%) of strain (%) of individual particles belonging to each group is obtained. The median value R (μm) of particle sizes of each group (for example, 5.125 μm in the group of not less than 5.000 μm to less than 5.250 μm) is plotted on the x-axis, and the average value $a_{80}$(%) of the strain of particles belonging to each group is plotted on the y-axis. In this way, a particle-size (x-axis)-strain (y-axis) curve (R-$A_{80}$ curve) is prepared. In the R-$A_{80}$ curve, the strain value corresponding to a number average particle size of toner $D1_1$ (μm) is represented by $B_{10}$(%). More specifically, in the R-$A_{80}$ curve, $B_{10}$(%), which is a value on the y-axis when a value on the x-axis is $D1_1$ (μm), is read off from the graph of the R-$A_{80}$ curve. Based on the values of $B_{10}$ and $A_{80a}$, a change rate of $B_{10}$ and $A_{80a}$, ϕ (%) [$\phi=(A_{80a}-B_{10})\times100/B_{10}$] is calculated. Similarly, in the R-$A_{80}$ curve, it is assumed that a strain value corresponding to a particle size which is 1.2 times $D1_1$, ($D1_1\times1.2$) (μm) is $B_{12}$(%), and a strain value corresponding to a particle size which is 0.8 times $D1_T$, ($D1_T\times0.8$) (μm) is $B_{08}$ (%). Using these values, the inclination α of $B_{12}$ and $B_{08}$, that is, [$\alpha=(B_{12}-B_{08})/(D1_T\times0.4)$], is calculated. Note that measurement is performed under the condition of a measuring temperature set at a glass transition point T1 of the toner −10 (° C.).

Next, $C_{10}$, $C_H$, $C_{12}$ and β of the present invention will be described. The aforementioned measurement is performed with respect to each of 50 toner particles to obtain load (x-axis)-strain (y-axis) curves. In the curves, a tangent line is drawn to a load at which the curve has the maximum inclination in the region beyond a load of $7.85\times10^{-5}$ N (8.00 mgf), and a linear line is drawn connecting a point on the curve corresponding to a load of $3.92\times10^{-5}$ N (4.00 mgf) to a point on the curve corresponding to a load of $7.85\times10^{-5}$ N (8.00 mgf). The load Cn at the intersection point (in other words, inflection point) between the tangent line and the linear line is obtained. Categorization into groups is performed in the same manner as above at intervals of 0.250 μm. In each group, the average value C(N) of Cn values belonging to each group is obtained. Similarly as described above, R (μm) is plotted on the x-axis and the average value C(N) of each group is plotted on the y-axis. In this way, a particle-size (x-axis)-inflection point (y-axis) curve (R-C curve) is prepared. In the R-C curve, the value of C corresponding to the number average particle size of toner $D1_T$ (μm) is represented by $C_{10}$(N). More specifically, in the R-C curve, $C_{10}$(N), which is a value on the y-axis when a value of the x-axis is $D1_T$ (μm) is read off from the graph of the R-C curve. Similarly, in the R-C curve, it is assumed that a value C corresponding to a particle size which is 1.2 times $D1_T$, ($D1_T\times1.2$) (μm) is $C_{12}$ (N), and a value C corresponding to a particle size which is 0.8 times $D1_T$, ($D1_T\times0.8$) (μm) is $C_H$ (N). Using these values, an inclination β of $C_{12}$ and $C_H$, that is, [$\beta=(C_{12}-C_{08})/(D1_T\times0.4)$], is calculated. Note that the measurement is performed under the condition of a measuring temperature set at a glass transition point T1 of the toner −10 (° C.).

Furthermore, $S_{1b}/S_{1a}$ and $s_{2b}/S_{2a}$ in the present invention will be described. A load (x-axis)-strain (y-axis) curve with respect to a single toner particle is prepared in the same manner as above except that in the micro compression test the measuring temperature is set at a glass transition point T1 of the toner +5 (° C.). In the curve, corresponding to the aforementioned $s_{1a}$ is obtained in the same manner as in the $s_{1a}$. $s_{2b}$ corresponding to the aforementioned $s_{2a}$ is obtained in the same manner as in the $s_{2a}$. The $s_{1a}$, $s_{1b}$, $s_{2a}$ and $s_{2b}$ of 50 toner particles determined in the same manner are used to obtain their average values $S_{1a}$, $S_{1b}$, $S_{2a}$ and $S_s$. Using these values, the ratio between $S_{1a}$ and $S_{1b}$, ($S_{1b}/S_{1a}$), and the ratio between $S_{2a}$ and $S_{2b}$, ($S_{2b}/S_{2a}$), are calculated.

In the toner of the present invention, the strain $A_{80a}$ obtained by the micro compression test at $T_1$-(° C.) is 35.0 to 75.0%. In the present invention, $A_{80a}$ represents deformability of toner at a temperature in the vicinity of a glass transition point (Tg) of the toner. This means that the larger the value of $A_{80a}$ is, the larger the degree of deformation of toner at a temperature in the vicinity of Tg of toner becomes. In other words, the larger the value of $A_{80a}$ is, the better the low-temperature fixing performance and glossing performance of toner are. If the value of $A_{80a}$ falls within the aforementioned range, particularly excellent low-temperature fixing performance and glossing performance can be obtained. In addition, particularly good anti-soaking performance can be obtained.

Furthermore, in the toner of the present invention, $S_{1a}/S_{2a}$, which is obtained in the micro compression test, falls within the range of 1.50 to 3.50. This is because, in a process of applying a load to toner up to $7.85\times10^{-4}$ N at a constant loading rate, the deformation behavior of toner observed in the initial stage of the measurement greatly differs from the deformation behavior of toner observed in a middle stage to a later stage. More specifically, in the toner of the present invention, the degree of deformation of toner is low in the initial stage immediately after the start of measurement; however, when a load exceeds a certain value in the middle stage, the deformation behavior drastically increases. When a load exceeds a value at which the inclination of the load (x-axis)-strain (y-axis) curve reaches a maximum in the later stage of measurement, the deformation behavior becomes mild again. This is a characteristic feature of the toner.

The feature of low deformation degree of toner in the initial stage shows that the toner has hardness and flexibility in response to a small load, with the result that the deformation remains reversible and small. As a method for improving the low-temperature fixing performance and glossing performance of toner, lowering Tg of the toner and making the toner sharply melting are known. However, in such a case, the toner becomes brittle and is easily broken in a developing apparatus. In particular, with a tendency of a high-speed operation of an electrophotographic apparatus, the toner is sometimes heated to a temperature near Tg of the toner by being rubbed with developing members such as a toner carrier and a charging member in the developing apparatus. In this case, the toner is easily broken in the developing apparatus upon receipt of mechanical stress by the developing members. The toner is broken in the developing apparatus to produce finely divided powder, which easily deposits on the toner carrier and the charging member, causing charge failure on the toner. In the present invention, since the toner has flexibility even at a temperature in the vicinity of Tg of the toner, the toner can be suppressed from being broken even if a certain amount of load and a mechanical stress are applied in the developing apparatus. Therefore, even when the low-temperature fixing performance and glossing performance of toner are to be improved, good running stability performance can be developed.

Furthermore, in the toner of the present invention, when the load to be applied to the toner exceeds a certain value, the deformation behavior greatly increases. In the region of a small load applied, the deformation of the toner remains reversible and small; however, when the load exceeds a certain value, the deformation of toner becomes irreversible and large. If the toner, which has hardness and flexibility sufficient to deform reversibly and slightly in the region of a small load, deforms reversibly and slightly in response to all amounts of load in the same manner, good developing stability can be obtained; however, the low-temperature fixing performance and glossing performance cannot be improved. Generally, a toner is deposited on paper in a single to several layers of toner in the height direction to form a toner image, which is then fixed by applying heat and pressure by a fixing member such as a fixing roller or a fixing film. At this time, the heat transmission rate between the fixing member and the toner layer, the heat transmission rate within the toner layer and the heat transmission rate between the toner layer and the paper are considered to be greatly affected by the area of a single toner particle in contact with the counter part to which heat is to be transmitted. Therefore, in the fixing process, if the area of the fixing member in contact with a toner particle can be momently increased, the heat transmission rate between them can be greatly increased. Within the toner layer, if the area of a toner particle in contact with an adjacent toner particle can be momently increased, the heat transmission rate between them can be greatly increased. When the area of a toner particle in contact with paper can be momently increased, the heat transmission rate between them can be greatly increased. Thus, the toner is characterized in that the deformation of toner remains reversible and small in a region of a small load applied; however the deformation of toner becomes irreversible and large when the load reaches a certain value or more. Because of the characteristics, low-temperature fixing performance and glossing performance and running stability performance never ever obtained are achieved.

Furthermore, in the toner of the present invention, the aforementioned $S_{1a}/S_{2a}$ value falls within a specific range. The $S_{1a}/S_{2a}$ value shows the relationship between the deformability of toner to a small load and the deformability of toner to a large load. In the micro compression test, $S_{1a}$ corresponds to the deformability of toner in the later half stage, whereas $S_{2a}$ corresponds to the deformability of toner in the initial stage. If the toner having the aforementioned $A_{80a}$ value within a specific range has the $S_{1a}/S_{2a}$ within a specific range, the well-balanced running stability performance, low-temperature fixing performance and glossing performance can be achieved. The $S_{1a}/S_{2a}$ preferably falls within the range of 1.5 to 3.0, and particularly preferably within the range of 2.0 to 3.0.

It is considered that the toner particle preferably expressing the aforementioned physical properties preferably has a core-shell structure. To describe more specifically, the toner particle of the toner according to the present invention contains at least wax and a colorant, and has a core phase containing a binder resin as a main component and a shell phase containing a surface-layer resin as a main component and covering the core phase. Furthermore, the toner particle preferably has inorganic fine powder on the surface of the shell phase. In such toner, the core phase is formed of a resin having a certain degree of softness as a main component and the shell phase is formed of a resin having a certain degree of hardness as a main component. In addition to this, if the thickness of the shell phase is sufficiently thin, the physical properties of the present invention are conceivably expressed satisfactorily. Furthermore, it is considered that when the cover state and thickness of the shell phase are uniform in the transverse direction and depth direction of the shell phase and the thickness of the shell phase is sufficiently thin, the toner has reversible flexibility enough to prevent breakage in response to application of a small load. However, it is also considered that when the shell phase is broken by application of a load in excess of a certain value, the toner may greatly deform irreversibly. When the core phase of the core-shell structure of a toner particle is sufficiently soft, if the cover state of the shell phase in the transverse direction and the thickness of the shell phase are not uniform, the toner particle easily deforms irreversibly even to a small load applied. Then, if the coat amount of the shell phase increases, the toner does not deform even to a large load applied. However, since the flexibility of the shell phase decreases, the toner becomes brittle when a load is momently applied and when the toner is exposed to a mechanical stress in the developing apparatus.

The value of $A_{80a}$ mentioned above can be controlled by Tg and molecular weight of a binder resin contained in the core phase as a main component, the shape of the core phase, the shape of a wax phase in the core phase and type of wax; and the Tg, molecular weight and addition amount of a surface-layer resin contained in the shell phase as a main component and the thickness and cover state of the shell phase. Furthermore, the $S_{1a}/S_{2a}$ value mentioned above can be controlled by managing the adhesion performance between the core phase and the shell phase other than the parameters exemplified with respect to the core phase and shell phase above.

In the toner of the present invention, a number average particle size of the toner is represented by $D1_T$ (μm). In the particle size (x-axis)-strain (y-axis) curve (R-$A_{80}$ curve) obtained in the aforementioned micro compression test, assuming that the value of strain corresponding to $D1_1$ is expressed by $B_{10}$(%), the change rate ϕ(%) between $B_{10}$ and $A_{80a}$, [$\phi=(A_{80a}-B_{10})\times100/B_{10}$], preferably falls within the range of 15.0% or less. On the other hand, assuming that the value of strain corresponding to the particle size 1.2 times $D1_1$ is expressed by $B_{12}$(%) and the value of strain corresponding to the particle size 0.8 times $D1_1$ is expressed by $B_{08}$(%), the inclination of $B_{12}$ and $B_{08}$ [$\alpha=(B_{12}-B_{08})/(D1_T\times0.4)$] is preferably −15.0 or less.

Generally, a toner has a certain level of a particle-size distribution. It is not impossible to aim at achieving toner having a completely single shape and single particle size; however, in consideration of productivity, toner particles having a certain level of particle size distribution may be economical. In addition, if the toner particles have a completely single shape and single particle size, the toner particles are easily packed in a developing apparatus, with the result that the running stability performance may decrease in some cases. If toner has a little level of particle size distribution, even through the toner is exposed to a mechanical stress, the force is likely to be scattered. In this aspect, the running stability performance of the toner is easily improved.

In the present invention, the aforementioned change rate ϕ of 15.0% or less means that the toner particles having the median particle size, in other words, the toner particles occupying the major part of the toner do not greatly deviate from an average value of physical properties of the whole toner. In other words, this means that there are contained almost no toner particles having physical properties greatly deviating from the average value of physical properties of the whole toner. In this case, a toner having particularly excellent running stability performance can be obtained. Note that the change rate ϕ is more preferably 10.0% or less, and particularly preferably 9.0% or less.

Furthermore, the aforementioned inclination α represents the difference of toner in the physical properties depending upon the toner particle size. When the α is 0, it shows that the physical properties of individual toner particles are completely the same regardless of their particle sizes. When the thicknesses of the shell phases covering individual toner particles are the same regardless of the particle sizes, such physical properties are conceivably expressed. Even if the physical property of the whole toner falls within a certain range, when the individual toner particles are compared one by one, the difference in physical property between the toner particles is sometimes large. In particular, in the case of a toner particle having a core-shell structure, the performance of the toner can be achieved by covering the core phase with the shell phase. Therefore, if the physical properties of individual toner particles vary, the toner performance may be significantly affected. For this reason, it is preferred that the α is −15.0 or less. In this case, the running stability performance of the toner becomes particularly satisfactory. In addition, it becomes easy to form a highly glossy image.

Particularly, in case of a toner having a core-shell structure and having toner particles with a certain level of particle size distribution, generally, a large toner particle tends to have a shell phase with a large thickness as compared with a small toner particle. Provided that the constitutional ratio of the core phase to the shell phase is equal, when only the thickness of the shell phase is compared, the thickness of the shell phase of large toner particles is larger than that of small toner particles. Actually, among toner particles different in particle size, the constitutional ratio of the core phase to shell phase tends to be biased. Therefore, the variation in the thickness of the shell phase to the particle size of toner tends to further increase. In the case of such toner, the value of $\alpha$ tends to be as small as less than −15.0. Of toner particles contained in such toner, a large toner particle having a thick shell phase tends to have inferior low-temperature fixing performance and glossing performance to those of a small toner particle having a thin shell phase. On the other hand, when the thickness of the shell phase is constant regardless of the particle size of a toner, the value of $\alpha$ approximates to zero. In this case, the toner having a particle size distribution and having both low-temperature fixing performance and anti-blocking performance in a balanced manner is considered to have good glossing performance and running stability performance.

Furthermore, the absolute value of $\alpha$ is preferably as small as possible. When $\alpha$ is 0.0, the running stability performance may rather decrease in some cases. This is considered because, when a toner having uneven particle size undergoes a mechanical stress, the stress tends to be concentrated to larger toner particles with a larger particle size, of the whole toner. For the reason, the value $\alpha$ more preferably falls within the range of −15.0 to −1.0, further preferably −10.0 to −1.0, and particularly preferably −8.0 to −2.0.

The value of the aforementioned $B_{10}$ can be controlled in the same control manner as in the case of the aforementioned $A_{80a}$. The values of the aforementioned $\phi$ and $\alpha$ can be controlled in the same control manner as in the case of the aforementioned $S_{1a}/S_{2a}$. Besides this, the values of the $\phi$ and $\alpha$ can be controlled by the content of the shell phase relative to the particle size of toner and the formation state of the shell phase.

According to the toner of the present invention, in the particle size (x-axis)-inflection point (y-axis) curve (R-C curve) obtained by the aforementioned micro compression test, assuming that the value of inflection point C corresponding to the aforementioned $D1_T$ is represented by $C_{10}$(N), the $C_{10}$ preferably falls within the range of $9.81\times10^{-5}$ to $3.43\times10^{-4}$N (10.00 to 35.00 mgf). On the other hand, assuming that the value of inflection point C corresponding to the particle size, which is 1.2 times $D1_T$, is represented by $C_{12}$(N) and the value of inflection point C corresponding to the particle size, which is 0.8 times $D1_T$, is represented by $C_H$(N), the inclination $\beta$ of $C_{12}$ and $C_{08}$, [$\beta=(C_{12}-C_{08})/(D1_T\times0.4)$] is preferably 15.0 or less.

When the aforementioned $C_{10}$ falls within the above range, well-balanced, running stability performance and low-temperature fixing performance or glossing performance of toner can be satisfactorily achieved.

The aforementioned $\beta$ represents breakability of toner particles varied depending upon the particle size thereof. The value $\beta$ of 0.0 indicates that individual toner particles have the same breakability regardless of the particle size thereof. If the toner whose physical property falls within the certain range contains a large amount of easy-breakable toner particles, the running stability performance tends to decrease accordingly. If the toner contains a large amount of hard toner particles, the low-temperature fixing performance and glossing performance tend to decrease accordingly.

The toner having a conventional/general core-shell structure contains relatively larger toner particles having a thick shell phase and relatively small toner particles having a thin shell phase. The infection point C is considered to have a great effect on the value of a load required until the shell phase is broken. Therefore, in the case of toner having a conventional/general core-shell structure, the aforementioned $\beta$ tends to be larger than 15.0. On the other hand, when toner particles have a shell phase with a uniform thickness regardless of the particle size, the $\beta$ approximates 0.0. In this case, it is considered that, also when it is aimed at to provide a toner having a particle size distribution with both low-temperature fixing performance and anti-blocking performance, the glossing performance and running stability performance are further improved.

Furthermore, the absolute value of $\beta$ is preferably as small as possible. When $\beta$ is 0.0, the running stability performance may decrease even slightly. When toner has toner particles with an uneven particle size and the toner is exposed to a mechanical stress, the stress tends to be concentrated to toner particles having a larger particle size, of the whole toner. Then, a large toner particle is a little more flexible than a small toner particle and relatively less breakable, so that the running stability performance of toner is easily improved. For the reason, the range of $\beta$ is more preferably 1.0 to 15.0, further preferably 1.0 to 10.0, and particularly preferably 2.0 to 8.0.

The value of $C_{10}$ can be controlled in the same control manner as in the case of $S_{1a}/S_{2a}$. The value of $\beta$ can be controlled in the same control manner as in the case of $S_{1a}/S_{2a}$. Besides this, the value of $\beta$ can be controlled by managing the content of the shell phase relative to the particle size of toner and the formation state of the shell phase.

In the toner of the present invention, it is preferred that the aforementioned ratio of $S_{1b}$ to $S_{1a}$, ($S_{1b}/S_{1a}$), is 1.2 to 3.0 and that the aforementioned ratio of $S_{2b}$ to $S_{2a}$, ($S_{2b}/S_{2a}$), is 2.0 to 6.0.

The $S_{1b}/S_{1a}$ ratio being within the aforementioned range means that the deformation amount of toner is large even if the temperature changes slightly in the vicinity of Tg of the toner. When the $S_{1b}/S_{1a}$ ratio falls within the aforementioned range, the low-temperature fixing performance, glass performance, anti-soaking performance and running stability performance of the toner are further improved. The $S_{1b}/S_{1a}$ ratio being within the aforementioned range means that in case of a toner having a core-shell structure it has a shell phase having appropriate thickness and hardness and has an appropriate hardness as a whole. The range of $S_{1b}/S_{1a}$ is more preferably 1.3 to 2.8, and particularly preferably 1.5 to 2.7.

The $S_{2b}/S_{2a}$ ratio being within the aforementioned range means that a change of the load-strain curve in shape is large even if the temperature changes slightly in the vicinity of Tg of the toner. When the $S_{2b}/S_{2a}$ ratio falls within the aforementioned range, the low-temperature fixing performance, gloss performance, anti-soaking performance and running stability performance of the toner are further improved. The $S_{2b}/S_{2a}$ ratio being within the aforementioned range means that in case of a toner having a core-shell structure it has a shell phase having appropriate thickness and hardness and has an appropriate hardness as a whole. The range of $S_{2b}/S_{2a}$ is more preferably 2.0 to 5.0, and particularly preferably 3.0 to 5.0.

The values of $S_{1b}/S_{1a}$ and $S_{2b}/S_{2a}$ can be controlled in the same manner as in aforementioned control of the $\beta$ and also controlled by taking the viscoelasticity of the shell phase.

The toner of the present invention contains a surface-layer resin in an amount of 1.0 to 10.0 parts by mass relative to 100.0 parts by mass of color particles (core particles). It is preferred that, in the loss tangent (tan $\delta$) curve obtained in a dynamic viscoelasticity test, the surface-layer resin has a maximum value of tan $\delta$ at a temperature $T_s$ (° C.) within the range of 45.0 to 85.0° C. On the other hand, it is preferred that, in the storage elastic modulus (G') curve obtained in the dynamic viscoelasticity test, the value of G' ($G'_{10}$) at a temperature of $T_s$+10 (° C.) is $1.0\times10^5$ to $5.0\times10^6$ Pa (1 dyn/cm$^2$=0.1 Pa), and the value of G' ($G'_{30}$) at a temperature of $T_s$+30 (° C.) is $1.0\times10^4$ to $5.0\times10^5$ Pa.

In the toner of the present invention, the surface-layer resin is considered to constitute the main component of a shell phase. The aforementioned $T_s$ (° C.) represents a glass transition point (Tg) of the surface-layer resin. In the field of toner, DSC is generally used for measuring the glass transition point of a resin. The $T_s$ obtained in the aforementioned measurement is a proper value to be discussed as Tg of a resin in the dynamic viscoelasticity test. In particular, in the case where the mechanical characteristics and thermal characteristics of the shell phase are both controlled as is in the present invention, it is considered that control is preferably performed by the dynamic viscoelasticity test rather than DSC.

When $T_s$ falls within the aforementioned range, both the anti-soaking performance and running stability performance can be satisfactorily achieved. The $T_s$ is more preferably 55.0 to 80.0° C., and particularly preferably 60.0 and 75.0° C.

When $G'_{10}$ and $G'_{30}$ fall within the aforementioned range, it is easy to control the values of $S_{1a}/S_{2a}$, $A_{80a}$ and $B_{10}$ and the anti-soaking performance and running stability performance of toner can be satisfactorily enhanced. Furthermore, when toner particles having a core-shell structure are formed in water, the toner particles can be suppressed from fusing with each other and additionally the adhesion between the core phase and the shell phase can be enhanced. The aforementioned $G'_{10}$ is more preferably $5.0\times10^5$ to $3.0\times10^6$ Pa, and particularly preferably $6.0\times10^5$ to $2.0\times10^6$ Pa. $G'_{30}$ is more preferably $4.0\times10^4$ to $5.0\times10^5$ Pa, and particularly preferably $8.0\times10^4$ to $5.0\times10^5$ Pa.

Furthermore, the ratio of $G'_{10}$ to $G'_{30}(G'_{10}/G'_{30})$ is preferably 2.5 to 10.0 in view of obtaining well-balanced, anti-blocking performance, low-temperature fixing performance, glossing performance, anti-soaking performance and running stability performance. Moreover, in toner having a core-shell structure with a thin shell layer, the adhesion between the core phase and the shell phase becomes satisfactory.

The content of the surface-layer resin is preferably 1.0 to 10.0 parts by mass relative to 100.0 parts by mass of the core particles as mentioned above. It is preferred that the content of the surface-layer resin is sufficiently low relative to the whole toner, and that the state of the shell phase formed is uniform on the surface of all toner particles. Under the condition that the content of the surface-layer resin fall within the aforementioned range, it is preferred to control the aforementioned values of $S_{1a}/S_{2a}$, $A_{80a}$, $B_{10}$, $C_{10}$, $\alpha$ and $\beta$. The content of the surface-layer resin is more preferably 1.5 to 8.5 parts by mass, and particularly preferably 2.5 to 6.0 parts by mass.

As a method for producing the toner of the present invention, for example, the following methods are included: (1) A method for forming toner particles having the surface-layer resin as the surface layer (shell phase), through a step of forming a color particle water dispersion solution having color particles (core phase) containing a binder resin, a colorant, wax and other additives as a dispersoid and water as a dispersion medium; and a step of forming a dispersion solution mixture by adding resin microparticles having the aforementioned surface-layer resin component to the water dispersion solution; and a step of immobilizing the resin microparticles to the surface of the color particles, (2) A method for forming toner particles having the surface-layer resin as the surface layer, through a step of forming an aqueous medium to which resin microparticles having the surface-layer resin are added; a step of adding a mixture containing a binder resin, a colorant, wax and other additives, and optionally an organic solvent, to the aqueous medium; and a step of granulating the mixture into particles in an aqueous medium, (3) A method for forming toner particles having the surface-layer resin as the surface layer, through a step of forming an aqueous medium to which resin microparticles having the surface-layer resin are added; a step of adding a mixture containing a polymerizable monomer serving as a raw material for a binder resin, a colorant, wax and other additives, to the aqueous medium; a step of granulating the mixture into particles in the aqueous medium; and a step of polymerizing the polymerizable monomer of the mixture, and (4) A method for forming toner particles having the surface-layer resin as the surface layer, through a step of adding a mixture containing the surface-layer resin, a polymerizable monomer serving as a raw material for a binder resin, a colorant, wax and other additives to an aqueous medium; a step of granulating the mixture into particles in the aqueous medium; and a step of polymerizing the polymerizable monomer of the mixture. Of them, the method (1) is particularly preferred in view of uniformity of the shell phase in the depth and transverse directions and in view of uniformity of the shell phase in connection with the particle size distribution of toner.

As the resin microparticles having the surface-layer resin, an aqueous dispersion solution of resin microparticles is preferably used, which have a volume average particle size $Dv_s$ of 20.0 to 150.0 nm and a zeta-potential $Z_{1s}$ (measured by the laser Doppler electrophoresis zeta potential measurement) of −110.0 to −35.0 mV. If the volume average particle size of the resin microparticles falls within the aforementioned range, the uniformity of the shell phase in the depth direction and the transverse direction becomes satisfactory even if the addition amount of the surface-layer resin to be added as the shell phase is reduced. Furthermore, the uniformity of the shell phase to the particle size distribution of toner is more improved. Moreover, the zeta potential $Z_{1s}$ of the resin microparticles is preferably −110.0 to −35.0 mV. The $Z_{1s}$ is conceivably derived from the type and content of acid group of the surface-layer resin. If $Z_{1s}$ falls within the aforementioned range, the adhesion between the core phase and the shell phase is more improved. Consequently, the $A_{80}$, $S_{1a}/S_{2a}$, $\alpha$ and $\beta$ mentioned above take suitable values, and low-temperature fixing performance, glossing performance and running stability performance can be expressed more satisfactorily.

Note that the range of $Dv_s$ mentioned above is more preferably 20.0 to 100.0 nm, and particularly preferably 25.0 to 80.0 nm. Furthermore, the range of $Z_1$, mentioned above is more preferably −95.0 to −35.0 mV, and particularly preferably −85.0 to −45.0 mV.

Preferably, the aforementioned resin microparticles have an acid value $Av_s$ of 3.0 to 40.0 mg KOH/g and a product of $Av_s$ and $Dv_s$ ($Av_s\times Dv_s$) preferably falls within the range of 200 to 1,000. When the toner particles having a core-shell structure are formed in water, if the acid value of the resin microparticles falls within the aforementioned range, an acid group easily interacts with the surface of the color particles. As a result, the adhesion between the core phase and the shell phase is easily improved. In addition, if the particle size of the resin microparticles falls within the aforementioned range, the addition amount of the resin microparticles occupied in the whole toner can be suppressed; at the same time, the amounts of the resin microparticles contained in individual particles tend to be equal. The value $Av_s$ of the surface-layer resin more preferably falls within the range of 6.0 to 35.0 mg KOH/g, and particularly preferably within the range of 6.0 to 30.0 mg KOH/g. Furthermore, the product ($Av_s\times Dv_s$) more preferably falls within the range of 200 to 600.

In the resin microparticles, the ratio between 10% particle size ($Dv_{s10}$) of the volume particle size distribution and $Dv_s$: ($Dv_s/Dv_{s10}$) preferably falls within the range of 1.0 to 10.0. In this case, even if the addition amount of the resin microparticles occupied in the whole toner is not increased, the amounts of the resin microparticles contained in individual particles tend to be equal. The value ($Dv_s/Dv_{s10}$) more preferably falls within the range of 1.0 to 5.0, and particularly preferably within the range of 1.0 to 4.0.

Furthermore, for the same reasons as mentioned above, in the resin microparticles, the ratio of 90% particle size ($Dv_{s90}$) of the volume particle size distribution relative to $Dv_s$ ($Dv_{s90}/Dv_s$) preferably falls within the range of 1.0 to 10.0. The ratio ($Dv_{s90}/Dv_s$) more preferably falls within the range of 1.0 to 6.0 and particularly preferably 1.0 to 4.0.

The volume average particle size ($Dv_s$) of the resin microparticles, 10% particle size of the volume particle size distribution ($Dv_{s10}$) and 90% particle size thereof ($Dv_{s90}$) can be measured, for example, by MICROTRAC UPA MODEL: 9232 (manufactured by Leeds and Northrup).

Measurement Conditions are as Follows:

Particle Material: Latex

Transparent Particles Yes

Spherical Particles Yes

Particle Refractive Index: 1.59

Fluid: water

The zeta potential of the resin microparticles is obtained by the laser Doppler electrophoresis zeta potential measurement. Assuming that a 10% zeta potential is represented by $Z_{s10}$ (mV) and a 90% zeta potential is represented by $Z_{s90}$ (mV), it is preferred that the ratio between $Z_{s10}$ and $Z_{1s}$:($Z_{1s}/Z_{s10}$) is 1.00 to 3.00 and that the ratio between $Z_{s90}$ and $Z_{1s}$ ($Z_{s90}/Z_{1s}$) is 1.00 to 3.00. If the ratios of $Z_{1s}/Z_{s10}$ and $Z_{s90}/Z_{1s}$ fall within the aforementioned range, even if the addition amount of the resin microparticles occupied in the whole toner is suppressed, the cover state of the resin microparticles over the surface of the toner particles becomes more uniform. In addition, the amounts of the resin microparticles contained in individual toner particles tend to be more equal. The case where micro resin particles are adsorbed by a core phase formed of color particles to form a shell phase in water is particularly preferred since the cover state of the shell phase becomes more uniform and aggregation (as a by-product) of the resin microparticles can be suppressed. Furthermore, if the ratio of $Z_{1s}/Z_{s10}$ falls within the aforementioned range, the values of $S_{1a}/S_{2a}$, $\alpha$ and $\beta$ are easily controlled so as to fall the aforementioned desired ranges. The ratio of $Z_{1s}/Z_{s10}$ is more preferably 1.00 to 2.5, and particularly preferably 1.00 to 2.00. Furthermore, the ratio of $Z_{s90}/Z_{1s}$ is more preferably 1.00 to 2.5, and particularly preferably 1.00 to 2.00.

As the resin that can be used as the surface-layer resin, use can be made of the same resins (as exemplified later) as those that can be used as a binder resin. Specifically, the resin preferably has polyester containing an alcohol having an ether bond, as a divalent alcohol component. As a specific example of the divalent alcohol having an ether bond, mention may be made of an alkylene oxide adduct of bisphenol A such as polyoxypropylene(2.2)-2,2-bis(4-hydroxyphenyl) propane, polyoxypropylene(3.3)-2,2-bis(4-hydroxyphenyl) propane, polyoxyethylene(2.0)-2,2-bis(4-hydroxyphenyl) propane, polyoxypropylene(2.0)-polyoxyethylene(2.0)-2,2-bis(4-hydroxyphenyl)propane, or polyoxypropylene(6)-2,2-bis(4-hydroxyphenyl)propane; diethylene glycol, triethylene glycol, dipropylene glycol, polyethylene glycol, polypropylene glycol, polytetramethylene glycol, a bisphenol derivative represented by the formula (1) below; or a compound represented by the formula (2) below.

(1)

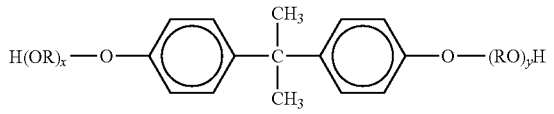

(where R represents an ethylene group or a propylene group; x and y each represent an integer of 1 or more; and an average value of x+y represents 2 to 10).

(2)

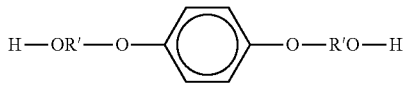

(where R' represents an ethylene group, a propylene group or a butylene group).

It is preferred that the surface-layer resin is polyester containing an alcohol having an ether bond as a divalent alcohol component in view of obtaining the low-temperature fixing performance, anti-blocking performance, running stability performance, anti-offset performance, image storage stability and anti-soaking performance of toner in a balanced manner. Since the main chain has a number of ether bonds, the surface-layered resin has appropriate affinity for color particles. Therefore, even if the addition amount of the surface-layer resin is small, the cover state of toner particles with the surface-layer resin tends to be more uniform.

As the polyvalent carboxylic acid component to be used in combination with the divalent alcohol, the following compounds may be mentioned:

Aromatic dicarboxylic acids such as phthalic acid, isophthalic acid and terephthalic acid or anhydrides thereof; alkyldicarboxylic acids such as succinic acid, adipic acid, sebacic acid and azelaic acid or anhydrides thereof, succinic acid substituted with an alkyl group having 6 to 12 carbon atoms or anhydrides thereof; unsaturated dicarboxylic acids such as fumaric acid, maleic acid and citraconic acid or anhydrides thereof; N-dodecenyl succinic acid; isododecenyl succinic acid; and trimellitic acid.

The surface-layer resin above is preferred to have an anionic hydrophilic functional group as shown below. It is preferred that the surface-layer resin above has an anionic hydrophilic functional group in view of obtaining the low-temperature fixing performance, anti-blocking performance, running stability performance, anti-offset performance and anti-soaking performance of toner in a balanced manner. Since the anionic hydrophilic functional group is present, the surface-layer resin has good affinity for color particles. Therefore, even if the addition amount of the surface-layer resin is small, the cover state of toner particles with the surface-layer resin tends to be more uniform.

As the anionic hydrophilic functional group, a sulfonic acid group, a carboxylic acid group, a phosphoric acid group and metal salts thereof or an alkyl ester can be used. As the metal salts, for example, alkaline metals such as lithium, sodium and potassium, and alkaline earth metals such as magnesium may be mentioned. Of them, a sulfonic acid functional group selected from a sulfonic acid group, an alkaline metal salt of a sulfonic acid group, and an alkyl ester salt of the sulfonic acid group is preferable in view of adhesion between a color particle and the surface-layer resin and uniformity of the cover state. Even if the addition amount of the surface-layer resin is small, the cover state of toner particles with the surface-layer resin tends to be particularly uniform.

The surface-layer resin preferably contains a sulfonic acid group in an amount of 0.10 to 4.00% by mass when the resin is regarded as 100.00% by mass. It is preferred that the content of the sulfonic acid group is 0.10 to 4.00% by mass, in view of obtaining the low-temperature fixing performance, anti-blocking performance, running stability performance, anti-offset performance, image storage stability and anti-soaking performance of toner in a balanced manner. If the content of the sulfonic acid group falls in the aforementioned range, the surface-layer resin can be suppressed from peeling off. Furthermore, even if the addition amount of the surface-layer resin is small, the cover state of toner particles with the surface-layer resin tends to be particularly uniform. The content of the sulfonic acid group is preferably 0.20 to 3.00% by mass and more preferably 0.40 to 2.00% by mass.

As a method for producing toner of the present invention, it is preferred to employ a method of producing toner particles through a step of forming a water dispersion solution by dispersing color particles (core particles), which have a weight average particle size $D4_c$ of 3.0 to 8.0 μm, and a zeta potential ($Z_{2c}$) (measured by the laser Doppler electrophoresis zeta potential measurement) of −15.0 mV or less and satisfy the relationship: ($Z_{1s}$+5.0) to ($Z_{1s}$+50.0) mV, in an aqueous medium containing an inorganic salt having a metal selected from Ca, Mg, Ba, Zn and Al; a step of forming a dispersion solution mixture by adding the dispersion solution of resin microparticles (separately prepared) to the water dispersion solution of the color particles; a step of heating the dispersion solution mixture to not less than $T_2$ (° C.) and not more than $T_s$ (° C.) where $T_2$ (° C.) is the glass transition point of the color particles measured by DSC; and a step of adjusting the pH of the dispersion solution mixture to 5.0 or less.

The inorganic salt selected from Ca, Mg, Ba, Zn and Al is preferred since they can be dissolved with addition of acid or alkali and easily removed by washing. Particularly preferable examples of the inorganic salt may include phosphates of a multivalent metal salt such as tricalcium phosphate, magnesium phosphate, aluminum phosphate and zinc phosphate; carbonates such as calcium carbonate and magnesium carbonate; inorganic salts such as calcium metasilicate, calcium sulfate and barium sulfate; and inorganic oxides such as calcium hydroxide, magnesium hydroxide, aluminum hydroxide, silica, bentonite and alumina.

If the $D4_c$ of the color particles falls in the aforementioned range, aggregation of toner particles with the resin microparticles interposed between them can be suppressed and running stability performance can be improved. In addition, the adhesion between the core phase and the shell phase can be enhanced and running stability performance can be further enhanced.

If the $Z_2$ falls within the aforementioned range, the water dispersion solution of the color particles is thermally and chemically stabilized. Furthermore, aggregation of color particles can be satisfactorily suppressed in the step of forming a dispersion solution mixture. Additionally, excellent adhesion between the core phase and the shell phase can be obtained.

As a preferable method for producing the toner of the present invention, a method including the steps (1) to (5) shown below may be mentioned.

(1) a step of forming a water dispersion solution of color particles containing a binder resin, colorant and wax in an aqueous medium having the aforementioned sparingly water-soluble inorganic salt, in which the $D4_c$ defined above falls within the range of 3.0 to 8.0 μm and $Z_{2c}$ defined above is −15.0 mV or less, and the relationship:($Z_{1s}$+5.0) to ($Z_{1s}$+50.0) mV is satisfied; (2) a step of forming a dispersion solution mixture by adding, to the water dispersion solution obtained above, a water dispersion solution containing resin microparticles having a Dv, (mentioned above) of 20.0 to 100.0 nm, an $Av_s$ (mentioned above) of 3.0 to 40.0 mg KOH/g, a value of ($Av_s \times Dv_s$) (mentioned above) of 200 to 1,000, a value of ($Dv_s/Dv_{s10}$) (mentioned above) within 1.0 to 10.0 and a value of ($Dv_{s90}/Dv_s$) (mentioned above) within 1.0 to 10.0; (3) a step (heating step 1) of heating the dispersion solution mixture to a temperature of not less than $T_2$ (° C.) and not more than $T_s$ (° C.); (4) a step (acid treatment step) of adjusting the pH of the dispersion solution mixture to 5.0 or less, and dissolving the aforementioned sparingly water-soluble inorganic salt; and (5) a step (heating step 2) of heating the dispersion solution mixture to a temperature of not less than $T_2$ (° C.) and not more than $T_s$−30(° C.) to $T_s$ (° C.) or less.

The aforementioned inorganic dispersing agent is uniformly adsorbed onto the surface of color particles and the individual color particles adsorb the inorganic dispersing agent in an equal amount. The inorganic dispersing agent interacts with the resin microparticles to produce adsorption force, by which the resin microparticles can be uniformly adsorbed onto the surface of a color particle and the individual color particles can contain the resin microparticles in an equal amount. After the inorganic dispersing agent and the resin microparticles are uniformly adsorbed onto the color particles, the color particles and the resin microparticles are softened in the heating step. Furthermore, in the step of dissolving the inorganic dispersing agent, the resin microparticles can be uniformly adsorbed onto the surface of a color particle and the resin microparticles can be contained in color particles in an equal amount. To describe more specifically, the sparingly water-soluble inorganic salt is sufficiently small compared to the color particles and the resin microparticles. The sufficiently small inorganic salt is uniformly adsorbed surface-chemically onto the surface of the color particle. Furthermore, the inorganic salt particles arranged uniformly on the surface of a color particle electrically interact with the resin microparticles, and thereby the resin microparticles are adsorbed to the inorganic salt. As long as the inorganic salt and the resin microparticles can be in contact with each other, the resin microparticles are adsorbed. Therefore, the surface of a color particle can be covered with only a single layer of the resin microparticles (while keeping a dense packing state) with the inorganic salt interposed between them. After this state is formed, the resin microparticles and the color particles are softened in the heating step. In the acid treatment step, while the inorganic salt is dissolved and exclusively removed, the resin microparticles can be immobilized onto the surface of the color particles. According to this method, a shell layer having a uniform thickness in all directions of the surface of a toner particle can be formed satisfactorily. Such uniformity may reflect the whole toner. Furthermore, in the case where the color particles have a certain degree of particle size distribution, it is considered that a shell layer having a thickness equivalent to the diameter of the resin microparticles can be uniformly formed regardless of large or small color particles.

The heating temperature in the heating step 1 above is more preferably $T_s$ (° C.) or less, and not less than $T_2$+5 (° C.) and not more than $T_2$+30 (° C.), and particularly preferably not less than $T_2$+5 (° C.), and not more than $T_2$+20 (° C.). If the heating temperature greatly differs from $T_s$, the addition amount of the resin microparticles occupied in the whole toner can be suppressed and the amounts of the resin microparticles contained in individual toner particles tend to be uniform.

In the acid treatment step, the pH is preferably controlled by a method of adding an aqueous hydrochloric acid solution. The concentration of the aqueous hydrochloric acid solution is preferably 0.05 to 1.00 mole/liter. The concentration of the aqueous hydrochloric acid solution is more preferably 0.10 to 0.60 mole/liter, and particularly preferably 0.10 to 0.40 mole/liter. The shell phases formed in individual toner particles tend to have uniform hardness.

In the acid treatment step, the aqueous hydrochloric acid solution is preferably added dropwise for 0.5 to 10.0 hours, more preferably 1.0 to 5.0 hours, and particularly preferably 2.0 to 4.0 hours. The shell phases formed in individual toner particles tend to have uniform hardness.

The heating temperature in the heating step 2 is preferably $T_2$ (° C.) or more, and not less than $T_s$−30 (° C.) and not more than $T_s$ (° C.), more preferably not less than the heating temperature in the heating step 1, and not less than $T_s$−20 (° C.) and not more than $T_s$−5 (° C.). This is because the adhesion between the core phase and the shell phase increases and the balance between running stability performance and low-temperature fixing performance can be improved.

In addition, the color particle preferably contains polyester near the surface thereof. Since the color particle contains polyester, the color particle interacts with the polyester, readily improving the uniformity of the inorganic dispersing agent to be adsorbed to the surface of the color particle. By virtue of this, more uniform and dense shell phase can be formed.

The toner of the present invention contains a tetrahydrofuran (THF) soluble component that can be extracted by the Soxhlet extraction method, in an amount of 60.0 to 95.0% by mass. The THF soluble component preferably contains a sulfur element derived from a sulfonic acid group, in an amount of 0.010 to 0.300% by mass. The sulfonic acid group herein is considered as a sulfonic acid group contained in the resin microparticles which are added to toner so as to constitute the shell portion. According to the present invention, when the content of the sulfonic acid group falls within the aforementioned range, the adsorption between the core portion and the shell portion can be improved. Therefore, even if the addition amount of the resin microparticles to be contained in toner is reduced, the physical properties defined in the present invention can be satisfactorily expressed. Thus, while good running stability performance is maintained, low-temperature fixing performance can be further improved.

If the content of the THF soluble component falls within the aforementioned range, the anti-offset performance and low-temperature fixing performance can be attained in a balanced manner. The content of the THF soluble component more preferably falls within the range of 60.0 to 90.0% by mass, and particularly preferably within the range of 70.0 to 90.0% by mass. The content of the THF soluble component can be controlled by the types and addition amounts of binder resin and a crosslinking agent, toner production conditions and so forth.

The content of the THF soluble component is defined as the value measured by the Soxhlet extraction method specifically shown below. Furthermore, the THF soluble component contained in toner represents the component recovered in the following manner.

A cylindrical filter paper (for example, No. 86R manufactured by Toyo Roshi Kaisha. Ltd. is available) is dried in vacuum at 40° C. for 24 hours and allowed to leave for 3 days in an environment controlled at a temperature of 25° C. and a humidity of 60% RH. Toner (1×ρ) g where ρ is a true density (g/cm$^3$) is weighed (W1 g) and placed in the cylindrical filter paper and loaded on a Soxhlet extractor. Extraction is performed using THF (200 ml) as a solvent in an oil bath of 90° C. for 24 hours. Thereafter, the Soxhlet extractor is cooled at a cooling rate of 1° C./min and then the cylindrical filter paper is gently taken out and dried in vacuum at 40° C. for 24 hours. This is allowed to leave for 3 days in an environment controlled at a temperature of 25° C. and a humidity of 60% RH. Thereafter, the amount of the solid content remaining on the cylindrical filter paper is weighed (W2 g). The solid content is defined as the THF insoluble component.

The content of THF soluble component of toner is calculated in accordance with the following expression:

The content of THF soluble component of toner (% by mass)=100−(W2/W1)×100

The elution component obtained above is filtrated by a quantitative filter paper (for example, quantitative filter paper No. 5A manufactured by ADVANTEC). From the obtained solution, volatile components are distilled off by use of an evaporator set at 40° C. and dried at 40° C. for 24 hours in vacuum. The resultant solid content is defined as the THF soluble component.

The true density of toner can be measured, for example, by a dry automatic densitometer, ACCUPYC 1330 (manufactured by Simadzu Corporation).

The THF soluble component contained in toner preferably has a weight average molecular weight (Mw) in terms of polystyrene (PSt) (determined by gel permeation chromatography (GPC)) within the range of 30,000 to 300,000. The ratio (Mw/Mn) between number average molecular weight (Mn) obtained by the aforementioned measurement and Mw preferably falls within the range of 2.0 to 20.0. If the THF soluble component has Mw and Mw/Mn within the aforementioned ranges, the balance between sharp-melting property of toner and maintenance of viscosity during melting is improved, with the result that the physical properties of the present invention can be satisfactorily expressed. As a result, the low-temperature fixing performance, anti-soaking performance and anti-offset performance are further improved. If Mw and Mw/Mn fall within the aforementioned ranges, $A_{80a}$ can be easily and satisfactorily controlled. As a result, excellent running stability performance, anti-offset performance, anti-soaking performance, low-temperature fixing performance and glossing performance can be obtained. The range of Mw is more preferably 40,000 to 150,000, and particularly preferably 50,000 to 150,000 (molecular weight). Furthermore, the range of Mw/Mn is more preferably 2.0 to 10.0, and particularly preferably 3.0 to 8.0.

Mw and Mw/Mn can be obtained within the aforementioned ranges by controlling the types and addition amounts of crosslinking agent and polymerization initiator, toner production conditions and so forth.

In the toner of the present invention, circularity thereof is measured by a flow-type particle image measuring apparatus having an image-processing resolution of 512×512 pixels (0.37 μm×0.37 μm/per pixel). The circularity values thus measured are divided into 800 parts within the circularity range of 0.200 to 1.000 and analyzed. The average circularity of toner preferably falls within the range of 0.945 to 0.995, more preferably 0.965 to 0.995, and particularly preferably 0.975 to 0.990. If the average circularity is less than 0.945, toner particles are easily broken from a depressed portion or a protruding portion of toner in a developer. Since the broken toner particles are deposited on a charging member or the like, running stability performance is likely to decrease. In the toner containing a surface-layer resin like the present invention, if the state of the surface-layer resin varies depending upon toner particles, the surface-layer resin forms depressed portions and protruding portions on toner particles. As a result, an average circularity tends to be reduced and the surface-layer resin is easily broken in a developer. If the circularity is larger than 0.995, the packing state of toner is likely to be extremely dense. Consequently, when improvement of the low-temperature fixing performance is attempted, running stability performance may decrease. Furthermore, in cleaning the photosensitive member drum, since the toner shape is too spherical, toner particles slip through a cleaning blade. As a result, insufficient cleaning may cause an image failure. The average circularity of the toner of the present invention can be controlled also by using a surface-modification apparatus (later described).

The average circularity of toner particles can be measured by a flow-type particle image analyzer "FPIA-3000" (manufactured by Sysmex Corporation).

Specifically, measurement can be performed by the following method. First, about 20 ml of ion-exchange water, from which solid impurities are removed in advance, is poured in a glass container. To this, a dilution solution (0.2 ml) of a dispersant, "Contaminon N" (a 10% (by mass) aqueous solution of a neutral detergent for washing precision measurement apparatuses containing a nonionic surfactant, an anionic surfactant and an organic builder, pH7; and manufactured by Wako Pure Chemical Industries) diluted with ion-exchange water up to 3-fold by mass, is added. Furthermore, 0.02 g of a test sample is added and dispersed for 2 minutes by an ultrasonic distributor to obtain a distribution solution for measurement. At this time, the distribution solution is appropriately cooled such that the temperature thereof falls within the range of not less than 10° C. and not more than 40° C. As the ultrasonic distributor, a desktop ultrasonic cleaner/distributor of an oscillation frequency of 50 kHz, an electric power of 150 W (for example, "VS-150" manufactured by VELVO-CLEAR) is used. A predetermined amount of ion-exchange water is placed in a water vessel, to which 2 ml of Contaminon N mentioned above is added.

Measurement is performed by the flow-type particle image analyzer having a standard object lens (10×) and using a particle sheath "PSE-900A" (manufactured by Sysmex Corporation) as the sheath solution. The dispersion solution prepared in accordance with the aforementioned procedure is introduced in the flow-type particle image analyzer. Then, 3,000 toner particles are measured by an HPF measurement mode and a total count mode. Subsequently, in the analysis of particles, a binary threshold is set at 85% and a particle size to be subjected to analysis is limited to a circle-equivalent diameter of not less than 1.985 μm to less than 39.69 μm. In this manner, an average circularity of the toner particles is obtained.

In measuring, before initiation of measurement, using standard latex particles (for example, "RESEARCH AND TEST PARTICLES Latex Microsphere Suspensions 5200A" (manufactured by Duke Scientific Corporation) diluted with ion-exchange water), auto focus control is performed. Thereafter, measurement is initiated and focus is preferably controlled every 2 hours.

Note that in the Examples of the present application, a flow-type particle image analyzer is used on which correction is operated by Sysmex Corporation and for which a correction certificate by Sysmex Corporation is issued. Measurement is performed under the same measurement and analysis conditions as those at the time when the correction certificate was issued, except that the particle size to be analyzed is limited to a circle-equivalent diameter of not less than 1.985 μm to less than 39.69 μm.

The measurement principle of the flow-type particle image analyzer "FPIA-3000" (manufactured by Sysmex Corporation) is that the image of flowing particles is taken as a still image, which is subjected to image analysis. A sample is added to a sample chamber and then fed to a flat-sheath flow cell by a sample suction syringe. The sample fed to the flat-sheath flow cell forms a flat flow in the state it is inserted in sheath solution. The sample passing through the flat-sheath flow cell is irradiated with strobe light at intervals of 1/60 seconds. Therefore, an image of flowing particles can be taken as a still image. In addition, since the flow is flat, a focused image can be taken. The particle image is taken by a CCD camera and the taken image is processed at an image processing resolution of 512×512 (0.37 μm×0.37 μm per pixel). The contour of each image is defined and a projection area S and peripheral length L of the particle image are measured.

Next, using the area S and peripheral length L, a circle-equivalent diameter and circularity are obtained. The circle-equivalent diameter is the diameter of a circle having the same area as the projection area of a particle image. The circularity C is defined as a value obtained by dividing the peripheral length of a circle, which is obtained from the circle-equivalent diameter, by the peripheral length of the projection image of a particle and calculated in accordance with the following expression:

$$\text{Circularity } C=2\times(\pi\times S)^{1/2}/L$$

When a particle image is circular, the circularity thereof is 1. The larger the degree of unevenness of the outer periphery of a particle image is, the smaller the circularity becomes. After the circularity of individual particles is calculated, the range of circularity of 0.200 to 1.000 is divided into 800 parts. An arithmetic mean of the obtained circularity values is calculated and defined as an average circularity.

In the toner of the present invention, the weight average particle size ($D4_T$) preferably falls within the range of 3.0 to 8.0 μm. When the $D4_T$ value falls within the aforementioned range, excessive packing of toner rarely occurs with the result that storage stability further increases. In addition, occurrence of image failure, which is caused by insufficient cleaning due to toner particles slipping through a cleaning blade during cleaning of a photosensitive drum, is suppressed. Furthermore, excellent granularity can be obtained even in a low concentration region, with the result that images reduced in roughness can be obtained. In the present invention, the $D4_T$ value is more preferably 3.5 to 6.5 μm, and particularly preferably 4.0 to 6.0 μm.

Next, materials for use in the toner of the present invention and a method for producing the same will be described.

As the binder resin to be used in the toner of the present invention, various types of known resins serving as a binder resin for electrophotographic toner can be used. Of them, a resin selected from (a) polyester, (b) a hybrid resin having polyester and a vinyl polymer, (c) a vinyl polymer and mixtures of these is preferably used as a main component. It is also preferred that the polyester contains a urethane bond and a urea bond.

As the monomer to be used in the binder resin of the present invention, for example, the following compounds described below can be specifically used.

As a divalent alcohol component, mention may be made of an alkylene oxide adduct of bisphenol A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane or polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A or a bisphenol derivative represented by the formula (VII) below:

(VII)

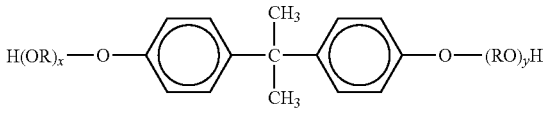

(where R represents an ethylene group or a propylene group, x and y each represents an integer of 1 or more and an average value of x+y represents 2 to 10), or a compound represented by the formula (VIII) below:

(VIII)

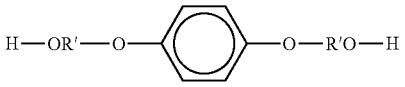

where R′ represents

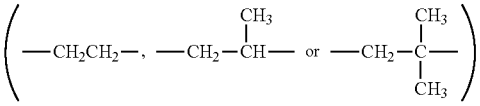

As a trivalent or more alcohol component, mention may be made of, for example, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane or 1,3,5-trihydroxymethylbenzene.

As a polyvalent carboxylic acid component and the like, mention may be made of, for example, aromatic dicarboxylic acids such as phthalic acid, isophthalic acid and terephthalic acid, or an anhydride thereof; alkyldicarboxylic acids such as succinic acid, adipic acid, sebacic acid and azelaic acid, or an anhydride thereof; succinic acid substituted with an alkyl group having 6 to carbon atoms or an anhydride thereof; unsaturated dicarboxylic acids such as fumaric acid, maleic acid and citraconic acid, or an anhydride thereof; n-dodecenyl succinic acid, isododecenyl succinic acid and trimellitic acid.

Of them, in particular, condensation polyester is preferred since polyester has good charging characteristics as toner. The condensation polyester is obtained by condensation between a diol component such as a bisphenol derivative represented by the formula (VIII) above and an alkyldiol having 2 to 6 carbon atoms, and a carboxylic acid component, which consists of a dicarboxylic acid or anhydride thereof, or a low alkyl ester thereof (e.g., fumaric acid, maleic acid, maleic acid, phthalic acid, terephthalic acid, trimellitic acid, pyromellitic acid, an alkyl dicarboxylic acid having 4 to 10 carbon atoms and acid anhydrides of these compounds) serving as an acid component.

Furthermore, as a polyvalent (trivalent or more) carboxylic acid component for forming a polyester resin having a cross-linking site, mention may be made of, for example, 1,2,4-benzenetricarboxylic acid, 1,2,5-benzenetricarboxylic acid, 1,2,4-naphthalenetricarboxylic acid, 2,5,7-naphthalenetricarboxylic acid, 1,2,4,5-benzenetetracarboxylic acid and anhydrides and ester compounds of these.

The use amount of the polyvalent (trivalent or more) carboxylic acid is preferably 0.1 to 1.9 mol % based on the all monomers. Furthermore, when, as a binder resin, a hybrid resin is used having a polyester unit, which is a polycondensation product between a polyvalent alcohol and a multi basic acid, and has an ester bond in the main chain, and a vinyl polymer unit, which is a polymer having an unsaturated hydrocarbon group, further satisfactory wax dispersibility, improvement of low-temperature fixing performance and anti-offset performance can be expected. The hybrid resin to be used in the present invention means a resin having a vinyl polymer unit and a polyester unit chemically bonded. More specifically, the hybrid resin is a resin obtained by a transesterification reaction between a polyester unit and a vinyl polymer unit, which is obtained by polymerizing monomers having a carboxylic acid ester such as an acrylic acid ester or a methacrylic acid ester; and more preferably a graft copolymer (or block copolymer) having a vinyl polymer as a stem polymer and a polyester unit as a branched polymer.

As the vinyl monomer for producing a vinyl polymer, for example, use may be made of styrene; styrene such as styrene, o-methylstyrene, m-methylstyrene, p-methylstyrene, α-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, or p-nitrostyrene and a derivative thereof; a styrene unsaturated mono-olefin such as ethylene, propylene, butylene, isobutylene; an unsaturated polyene such as butadiene or isoprene; a halogenated vinyl such as vinyl chloride, vinyldene chloride, vinyl bromide or vinyl fluoride; a vinyl ester such as vinyl acetate, vinyl propionate or vinyl benzoate; an α-methylene fatty acid monocarboxylic acid ester such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate or diethylaminoethyl methacrylate; an acrylic acid ester such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate or phenyl acrylate; vinyl ether such as vinyl methyl ether, vinyl ethyl ether or vinyl isobutyl ether; vinyl ketone such as vinyl methyl ketone, vinyl hexyl ketone or methyl isopropenyl ketone; an N-vinyl compound such as N-vinylpyrrole, N-vinyl carbazole, N-vinylindole or N-vinylpyrrolidone; a vinyl naphthalin; and an acrylic acid or a methacrylic acid derivative such as acrylonitrile, methacrylonitrile or acrylic amide.

Furthermore, use may be made of unsaturated dibasic acids such as maleic acid, citraconic acid, itaconic acid, alkenyl succinic acid, fumaric acid and mesaconic acid; unsaturated dibasic acid anhydrides such as maleic anhydride, citraconic anhydride, itaconic anhydride and alkenyl succinic anhydride; half esters of an unsaturated dibasic acid such as methyl maleate half ester, ethyl maleate half ester, butyl maleate half ester, methyl citraconate half ester, ethyl citraconate half ester, butyl citraconate half ester, methyl itaconate half ester, alkenyl methyl succinate half ester, methyl fumarate half ester and methyl mesaconate half ester; unsaturated dibasic acid esters such as dimethyl maleate and dimethyl fumarate; α-,β-unsaturated acids such as acrylic acid, methacrylic acid, crotonic acid and cinnamic acid; α-,β-unsaturated acid anhydrides such as crotonic anhydride and cinnamic anhydride;

anhydrides between an α,β-unsaturated acid and a lower fatty acid; and monomers having a carboxylic group such as alkenyl malonic acid, alkenyl glutaric acid, alkenyl adipic acid, an anhydride and a mono ester thereof.

Moreover, use may be made of acrylates or methacrylates such as 2-hydroxyethyl acrylate, 2-hydroxyethyl methacrylate, and 2-hydroxypropyl methacrylate; and monomers having a hydroxyl group such as 4-(1-hydroxy-1-methylbutyl) styrene and 4-(1-hydroxy-1-methylhexyl)styrene.

In the toner of the present invention, the vinyl polymer unit of a binder resin may have a crosslink structure bridged with a crosslinking agent having not less than two vinyl groups. Examples of the crosslinking agent to be used herein may include aromatic divinyl compounds such as divinylbenzene and divinyl naphthalene; diacrylate compounds connected by an alkyl chain such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate and the same compounds as mentioned above except that acrylate is changed to methacrylate; and diacrylate compounds connected by an alkyl chain containing an ether bond such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and the same compounds as mentioned above except that acrylate is changed to methacrylate; and diacrylate compounds connected by a chain containing an aromatic group and an ether bond such as polyoxyethylene(2)-2,2-bis(4-hydroxyphenyl)propane diacrylate, polyoxyethylene(4)-2,2-bis(4-hydroxyphenyl)propane diacrylate and the same compounds as mentioned above except that acrylate is changed to methacrylate.

As a polyfunctional crosslinking agent, mention may be made of pentaerythritol triacrylate, trimethylolethane triacrylate, trimethylolpropane triacrylate, tetramethylolmethane tetraacrylate, oligoester acrylate and the same compounds as mentioned above except that acrylate is changed to methacrylate; triallyl cyanurate; and triallyl trimellitate.

The hybrid resin to be used in the present invention preferably contains a monomer component capable of reacting with both resin components of a vinyl polymer unit and a polyester unit, in either one or both units. Of the monomers constituting the polyester unit, as a monomer capable of reacting with a vinyl polymer unit, mention may be made of an unsaturated dicarboxylic acid such as phthalic acid, maleic acid, citraconic acid or itaconic acid, or an anhydride thereof. Of the monomers constituting the vinyl polymer unit, as a monomer capable of reacting with a polyester unit, mention may be made of a monomer having a carboxyl group or a hydroxy group, an acrylate or a methacrylate.

As a method for obtaining a reaction product between a vinyl polymer unit and a polyester unit, a method, in which either one or both of resins are polymerized in the presence of polymers containing monomer components capable of reacting with the corresponding units to obtain a reaction product, is preferred.

As the polymerization initiator to be used for producing a vinyl polymer of the present invention, for example, use may be made of ketone peroxides such as 2,2'-azobisisobutyronitrile, 2,2'-azobis(4-methoxy-2,4-dimethylvaleronitrile), 2,2'-azobis(-2,4-dimethylvaleronitrile), 2,2'-azobis(-2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2'-azobis(2-methyl-propane), methylethylketone peroxide, acetylacetone peroxide and cyclohexanone peroxide, 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, di-cumyl peroxide, α,α'-bis(t-butyl peroxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, di-isopropyl peroxydicarbonate, di-2-ethylhexyl peroxydicarbonate, di-n-propyl peroxydicarbonate, di-2-ethoxyethyl peroxycarbonate, di-methoxyisopropyl peroxydicarbonate, di(3-methyl-3-methoxybutyl)peroxycarbonate, acetylcyclohexylsulfonyl peroxide, t-butyl peroxyacetate, t-butyl peroxyisobutyrate, t-butylperoxyneodecanoate, t-butyl peroxy-2-ethyl hexanoate, t-butyl peroxylaurate, t-butyl peroxybenzoate, t-butyl peroxyisopropylcarbonate, di-t-butyl peroxyisophthalate, t-butyl peroxyallylcarbonate, t-amylperoxy-2-ethyl hexanoate, di-t-butyl peroxyhexahydroterephthalate and di-t-butyl peroxyazelate.

As a production method for preparing the aforementioned hybrid resin, for example, the following production methods (1) to (5) can be mentioned.

(1) A method for obtaining a hybrid resin by separately producing a vinyl polymer and a polyester rein, dissolving/swelling them in a small amount of organic solvent, and adding an esterification catalyst and an alcohol, and heating to perform a transesterification reaction.

(2) A method in which a vinyl polymer is produced and thereafter a polyester unit and a hybrid resin component are produced in the presence of the vinyl polymer. The hybrid resin component is produced by the reaction between a vinyl polymer (if necessary, a vinyl monomer can be added) and either one or both of a polyester monomer (alcohol, carboxylic acid) and polyester. Also in this case, an organic solvent can be appropriately used.

(3) A method in which a polyester unit is produced and thereafter a vinyl polymer and a hybrid resin component are produced in the presence of the polyester unit. The hybrid resin component is produced by the reaction between either one or both of the polyester unit (if necessary, a polyester monomer can be added) and the vinyl monomer.

(4) After a vinyl polymer unit and a polyester unit are produced, either one or both of a vinyl monomer and a polyester monomer (alcohol, carboxylic acid) are added in the presence of these polymer units to produce a hybrid resin component. Also in this case, an organic solvent can be appropriately used.

(5) A vinyl polymer and a polyester monomer (alcohol, carboxylic acid, etc.) are mixed and an addition polymerization reaction and a condensation polymerization reaction are sequentially performed to produce a vinyl polymer, a polyester unit and a hybrid resin component. Furthermore, an organic solvent can be appropriately used.

In the production methods (1) to (5), as a vinyl polymer unit and a polyester unit, a plurality of polymer units having different molecular weights and crosslinking degrees can be used.

Furthermore, after a hybrid resin component is produced, either one or both of a vinyl monomer and a polyester monomer (alcohol, carboxylic acid) are added and at least either one of an addition polymerization reaction and a condensation polymerization reaction is performed. In this manner, a vinyl polymer unit and a polyester unit may further be contained.

Note that, as the binder resin to be contained in the toner of the present invention, a mixture of the polyester resin and the vinyl polymer, a mixture of the hybrid resin and the vinyl polymer and a mixture of the polyester resin, the hybrid resin and the vinyl polymer may be used.

The toner of the present invention contains one or two or more types of wax. As the wax that can be used in the present invention, for example, mention may be made of aliphatic hydrocarbon waxes such as a low-molecular weight polyethylene, a low-molecular weight polypropylene, an olefin copolymer, a microcrystalline wax, paraffin wax and Fischer-Tropsch wax; oxides of an aliphatic hydrocarbon wax such as oxidized polyethylene wax; block copolymers such as an aliphatic hydrocarbon wax; waxes containing an aliphatic ester, as a main component, such as carnauba wax and montanoate wax; and waxes whose aliphatic ester is partly or wholly deoxidized such as deoxidized carnauba wax. For example, as the ester waxes, behenyl behenate and stearyl stearate may be mentioned.

Additionally, partially esterified compounds of an aliphatic acid and a polyhydric alcohol, such as behenic acid monoglyceride; and methyl ester compounds having a hydroxyl group obtained by hydrogenating vegetable oil may be mentioned.

In the molecular weight distribution of wax, a main peak preferably falls within the molecular-weight range of 350 to 2,400, and more preferably within the molecular-weight range of 400 to 2,000. If wax having such a molecular weight distribution is used, preferable thermal properties can be imparted to toner.

Furthermore, the content of the wax is preferably 3 to 30 parts by mass relative to 100 parts by mass of a binder resin. In the toner of the present invention, part of wax contained in the toner is dissolved together with a binder resin component and used as a plasticizer in producing toner. Furthermore, in a fixing process, part of the wax contained in toner is dissolved together with a binder resin and used as a plasticizer. Therefore, the whole amount of wax contained in toner does not serve as a mold release agent. Thus, wax is preferably contained in a larger amount than usual. The content of wax is more preferably 5 to 20 parts by mass, and particularly preferably 6 to 14 parts by mass.

When it is necessary to extract wax from toner in order to obtain the aforementioned properties, the extraction method is not particularly limited and any method can be employed.

For example, a predetermined amount of toner is subjected to Soxhlet extraction with toluene. From the obtained toluene soluble component, the solvent is removed to obtain a chloroform insoluble content.

Thereafter, identification analysis is performed by e.g., the IR method.

Furthermore, as to quantitative determination, quantitative analysis is performed by DSC.

Of these wax components, a wax showing a maximum endothermic peak within the range of 60 to 140° C. in the DSC curve (obtained by differential scanning calorimetry) is preferable and a wax showing a maximum endothermic peak within the range of 60 to 90° C. is further preferable. A wax having a maximum endothermic peak within the aforementioned range largely contributes to low-temperature fixation. At the same time, mold-releasing property can be effectively expressed. When the maximum endothermic peak is less than 60° C., self aggregation of the wax component becomes weak, with the result that anti-offset performance to high temperature deteriorates. On the other hand, when the maximum endothermic peak exceeds 140° C., the fixing temperature increases and low-temperature offset is likely to occur. Furthermore, when toner is directly obtained by a polymerization method in an aqueous medium, if the maximum endothermic peak is high, a problem, that is, precipitation of a wax component, may occur mainly in a granulation process, when a large amount of wax component is added.

In the toner of the present invention, a charge control agent may be used.

As the charge control agent for controlling the toner so as to be negatively charged, for example, mention may be made of an organic metal compound, a chelate compound, a mono azo metal compound, an acetylacetone metal compound, a urea derivative, a metal-containing salicyl acid compound, a metal-containing naphthoic acid compound, a quaternary ammonium salt, calixarene, a silicon compound, a non-metal carboxylate compound and a derivative thereof.

As the charge control agent for controlling the toner so as to be positively charged, for example, mention may be made of compounds modified with nigrosin and a fatty acid metal salt, tributylbenzylammonium-1-hydroxy-4-naphthosulfonate, a quaternary ammonium salt such as tetrabutylammonium tetrafluoroborate, and analogues of these including onium salts such as phosphonium salts and lake pigments of these, triphenylmethane dyes and lake pigments of these (examples of a laking agent may include tungstophosphoric acid, phosphomolybdic acid, tungsto-phosphomolybdic acid, tannic acid, lauric acid, gallic acid, ferricyanide and ferrocyanide), metal salts of higher fatty acids; diorgano tin oxide such as dibutyl tin oxide, dioctyl tin oxide and dicyclohexyl tin oxide; and diorgano tin borate such as dibutyl tin borate, dioctyl tin borate and dicyclohexyl tin borate. These may be used alone or as a mixture of two types or more. Of them, charge control agents such as a nigrosin compound and a quaternary ammonium salt are particularly preferably used.

The charge control agent above is preferably contained in an amount of 0.01 to 20 parts by mass based on 100 parts by mass of a binder resin contained in toner, and more preferably in an amount of 0.5 to 10 parts by mass.

The toner of the invention contains a colorant. A black colorant colored in black by use of a colorant such as carbon black, a magnetic substance, or yellow, magenta and cyan colorants as described below may be used.

As the colorants for cyan toner, magenta toner and yellow toner, for example, the following colorants can be used.

As the yellow colorant, more specifically, as a pigment, compounds represented by a condensed azo compound, an iso-indolinone compound, an anthraquinone compound, an azometallic complex methine compound and an allyl amide compound may be used. More specifically, C.I. pigment yellow 3, 7, 10, 12 to 15, 17, 23, 24, 60, 62, 74, 75, 83, 93 to 95, 99, 100, 101, 104, 108 to 111, 117, 123, 128, 129, 138, 139, 147, 148, 150, 166, 168 to 177, 179, 180, 181, 183, 185, 191:1, 191, 192, 193 and 199 may be preferably used. As a dye, for example, C.I. solvent yellow 33, 56, 79, 82, 93, 112, 162 and 163, and C.I. disperse yellow 42, 64, 201 and 211 may be mentioned.

As the magenta colorant, a condensed azo compound, a diketo pyrrolo pyrrole compound, an anthraquinone, a quinacridon compound, a base-dye lake compound, a naphthol compound, a benzimidazolone compound, a thioindigo compound and a perylene compound may be used. More specifically, C.I. pigment red 2, 3, 5 to 7, 23, 48:2, 48:3, 48:4, 57:1, 81:1, 122, 146, 166, 169, 177, 184, 185, 202, 206, 220, 221, 254, C.I. pigment violet 19 may be mentioned.

As the cyan colorant, for example, a cupper phthalocyanine compound and a derivative thereof, an anthraquinone compound and a base-dye lake compound may be used. More specifically, C.I. pigment blue 1, 7, 15, 15:1, 15:2, 15:3, 15:4, 60, 62 and 66 may be mentioned.

These colorants can be used alone or as a mixture and further in a solid-solution state. The colorant of the present invention is selected in view of a hue angle, chroma, brightness, weather fastness, OHP penetrability and dispersibility to toner. The colorant is used and added so as to be in an amount of 0.4 to 20 parts by mass relative to 100 parts by mass of a binder resin.

Furthermore, the toner of the present invention can be used as magnetic toner by adding a magnetic substance thereto. In this case, the magnetic substance may serve also as a colorant. In the present invention, examples of the magnetic substance may include iron oxides such as magnetite, hematite and ferrite; metals such as iron, cobalt and nickel or alloys containing these metals and metals such as aluminum, cobalt, copper, lead, magnesium, tin, zinc, antimony, berylium, bismuth, cadmium, calcium, manganese, selenium, titanium, tungsten and vanadium; and mixtures thereof.

These magnetic substances preferably have an average particle size of 2 μm or less, preferably about 0.1 to 0.5 μm. The content thereof in toner is preferably 20 to 200 parts by mass relative to 100 parts by mass of the binder resin, and particularly preferably, 40 to 150 parts by mass.

As the magnetic substance, it is preferred to use a magnetic substance having, as magnetic properties, a coercive force (Hc) of 1.59 to 23.9 kA/m (20 to 300 oersted), a magnetization strength (σs) of 50 to 200 $Am^2/kg$ and a residual magnetization (σr) of 2 to 20 $Am^2/kg$, when 796 kA/m (10 k oersted) is applied.

Furthermore, in the toner of the present invention, as a fluidity improver, inorganic fine powder or hydrophobic inorganic fine powder is preferably mixed by being externally adding it to toner particles. For example, titanium oxide fine powder, silica fine powder or alumina fine powder is preferably added and particularly preferably, silica fine powder is used.

The inorganic fine powder for use in the toner of the present invention preferably has a specific surface area (based on nitrogen adsorption measured by the BET method) of 30 $m^2/g$ or more, and particularly within the range of 50 to 400 $m^2/g$, because good results can be expected.

In the toner of the present invention, if necessary, additives other than the fluidity improver may be externally added and mixed with toner particles.

For example, in order to improve, e.g., cleaning performance, microparticles having a primary particle size beyond 30 nm (preferably having a specific surface area of less than 50 $m^2/g$), more preferably inorganic microparticles or organic microparticles of a nearly spherical shape having a primary particle size of 50 nm or more (preferably having a specific surface area of less than 30 $m^2/g$) are further added to toner particles. This is also a preferable embodiment. For example, spherical silica particles, spherical polymethylsilsesquioxane particles or spherical resin microparticles are preferably used.

Furthermore, other additives may be added, which, for example, include a lubricant powder such as a polyethylene fluoride powder, a zinc strearate powder or a polyvinylidene fluoride powder; or a polishing agent such as a cerium oxide powder, a silicon carbide powder or a strontium titanate powder; a caking preventing agent; or a conductivity imparting agent such as a carbon black powder, a zinc oxide powder or a tin oxide powder. Additionally, antipolarity organic microparticles and inorganic microparticles may be added in a small amount as a developing-property improver. These additives may be subjected to a hydrophobic surface treatment and put in use.

It is preferred that the external additive mentioned above is used in an amount of 0.1 to 5 parts by mass (preferably 0.1 to 3 parts by mass) relative to 100 parts by mass of toner particles.

The method for producing toner is not particularly limited as long as toner satisfying the physical properties specified by the present invention can be produced. A known method such as a pulverizing method using an air-flow pulverizer or a mechanical pulverizer can be used. When toner particles are produced by the pulverization method, a spheroidizing treatment can be also applied.

Moreover, the toner of the present invention can be produced by a method of atomizing a molten mixture in the air by use of a disk or multi fluid nozzles to obtain spherical toner particles; a dispersion polymerization method using an aqueous organic solvent in which a monomer is soluble but a polymer is insoluble, thereby directly producing toner; or an emulsion polymerization method represented by a soap-free polymerization method, in which direct polymerization is performed in the presence of a water-soluble polar polymerization initiator to produce toner. Also, the toner may be produced by a dissolution/suspension method, an emulsion/aggregation method or the like.

As a particularly preferable production method, a suspension/polymerization method may be mentioned, in which polymerizable monomers are directly polymerized in an aqueous medium.

In producing toner by the suspension polymerization method, generally, components such as a polymerizable monomer, a colorant, wax, a charge control agent and a crosslinking agent are uniformly dissolved or dispersed by a disperser such as a homogenizer, a ball mill, a colloid mill or an ultrasonic disperser. The monomer composition thus obtained is suspended in an aqueous medium containing a dispersion stabilizer. At this time, a high-speed disperser such as a high-speed stirrer or an ultrasonic disperser is preferably used to obtain toner particles having a desired size at one stroke, because the obtained particles provide a sharp particle size distribution. A polymerization initiator may be added to a monomer composition in advance or after the monomer composition is suspended in an aqueous medium.

After suspension, stirring may be performed by use of a general stirrer to the extent that the state of particles can be maintained and floating/precipitation of particles are prevented. Note that, in the present invention, the pH of the suspension solution is preferably 4 to 10.5 in view of controlling the particle size distribution of toner particles and controlling the charge amount.

In the suspension polymerization method, a known surfactant and an organic or inorganic dispersant can be used as a dispersion stabilizer. Of them, an inorganic dispersant can be preferably used because stability rarely decreases even if the reaction temperature is varied. Examples of such an inorganic dispersant may include phosphates of a polyvalent metal such as tricalcium phosphate, magnesium phosphate, aluminum phosphate and zinc phosphate; carbonates such as calcium carbonate and magnesium carbonate; inorganic salts such as calcium metasilicate, calcium sulfate and barium sulfate; and inorganic oxides such as calcium hydroxide, magnesium hydroxide, aluminum hydroxide, silica, bentonite and alumina.

It is preferred that these inorganic dispersants may be used alone or as a mixture of two types or more and in an amount of 0.2 to 20 parts by mass relative to 100 parts by mass of a polymerizable monomer. To obtain toner more reduced in size, for example, having an average particle size of 5 μm or less, surfactant may be used together in an amount of 0.001 to 0.1 parts by mass.

Examples of the surfactant may include dodecylbenzene sodium sulfate, sodium tetradecyl sulfate, sodium pentadecyl sulfate, sodium octyl sulfate, sodium oleate, sodium laurate, sodium stearate and potassium stearate.

These inorganic dispersants may be used as they are. In order to obtain particles more reduced in size, it is preferred that the inorganic dispersants are produced in an aqueous medium. More specifically, for example, in the case of tricalcium phosphate, an aqueous sodium phosphate solution and an aqueous calcium chloride solution are mixed under stirring at a high rate. In this manner, tricalcium phosphate poorly soluble in water can be produced and contributes to more uniform and fine dispersion. After completion of polymerization, the inorganic dispersant is dissolved with acid or alkali and removed almost completely.

In the polymerization step, polymerization is performed by setting a polymerization temperature at 40 C or more, generally at 50 to 90° C. When polymerization is performed within the temperature range, a binder resin and wax are separated into phases with the progress of polymerization. As a result, toner having wax contained therein can be obtained. At the end of the polymerization reaction, it is also preferred that the reaction temperature is increased up to 90 to 150° C.

The toner of the present invention can be used as toner for a one-component system developer and also used as toner for a two-component system developer having a carrier.

When the toner is used for the two-component system developer, the toner of the present invention and a carrier are mixed and used as a developer. The carrier is constituted of a single element selected from iron, copper, zinc, nickel, cobalt, manganese and chrome or a mixed ferrite. The shape of the carrier may be spherical, flat or indeterminate form. Any one of the shapes may be used. Furthermore, it is preferred that a microstructure (such as unevenness of the surface) of the carrier surface is controlled.

As a method for producing the carrier, a method of baking and granulating ferrite as mentioned above to produce a carrier core in advance and thereafter covering the surface of the core with a resin may be mentioned. To reduce load of the carrier upon toner, a method of obtaining a low-density dispersion carrier by kneading ferrite and a resin, pulverizing and classifying may be used, and further, a method of obtaining a true spherical carrier by directly suspending/polymerizing a kneaded product of ferrite and a monomer in an aqueous medium can be used.

The covered carrier produced by covering the surface of the carrier core with a resin is particularly preferably used. As the production method thereof, a method in which a resin is dissolved or suspended in a solvent and the solution or suspension is applied to the carrier to attach, and a method in which a resin powder and a carrier core are simply mixed to attach may be mentioned.

The substance covering the surface of the carrier core varies depending upon the material for toner. For example, mention may be made of polytetrafluoroethylene, a monochlorotrifluoroethylene polymer, polyvinylidene fluoride, a silicone resin, a polyester resin, a styrene resin, an acrylic resin, polyamide, polyvinylbutyral and an amino acrylate resin. These may be used alone or as a mixture of a plurality of substances.

As the magnetic properties of the carrier, it is preferred that a magnetization strength (σ 1000) after magnetically saturated at 79.6 kA/m (1 k oersted) is preferably 30 to 300 emu/cm$^3$. In this case, a high grade toner image can be easily obtained and furthermore deposition of the carrier can be suppressed. To obtain a further higher grade image, the magnetization strength is more preferably from 100 to 250 emu/cm$^3$.

The shape of the carrier is specified by SF-1 (preferably 180 or less) expressing degree of roundness and by SF-2 (preferably 250 or less) expressing degree of unevenness. SF-1 and SF-2 are defined by the following expressions and measured by LuzexIII manufactured by Nireco Corporation.

$$SF-1 = \frac{(\text{Maximum length of carrier})^2}{\text{Projection area of carrier}} \times \frac{\pi}{4} \times 100$$

$$SF-2 = \frac{(\text{Peripheral length of carrier})^2}{\text{Projection area of carrier}} \times \frac{1}{4\pi} \times 100$$

When a two-component system developer is prepared by mixing the toner of the present invention and the carrier, the mixing ratio of them in terms of the toner concentration in a developer is preferably 2 to 15% by mass, and more preferably 4 to 13% by mass.

<Measurement of Glass Transition Point (Tg) and Melting Point (Tm) of Toner and the Materials to be Used Herein by DSC>

The peak temperatures of the maximum endothermic peaks of wax and toner can be measured by the differential scanning calorimetric apparatus "Q1000" (manufactured by "TA Instruments") in accordance with ASTM D3418-82.

The temperature correction of the detection unit of the apparatus is performed by using the melting points of indium and zinc, and calorie correction is performed by using the heat of fusion of indium.

More specifically, toner (about 6 mg) is weighed and placed in a pan made of aluminum. As a reference, a vacant aluminum pan is used. Measurement is performed within the measurement range of 0 to 200° C. at a temperature raising rate of 1.0° C./min. During the temperature raising process, a specific-heat change occurs within the temperature range of 40° C. to 100° C. Base lines are drawn before and after the specific-heat change occurs. A line is drawn so as to pass through a median point between the base lines. The intersection between this line and the differential scanning calorimetric curve is defined as the glass transition point Tg of the binder resin.

Figure 2:
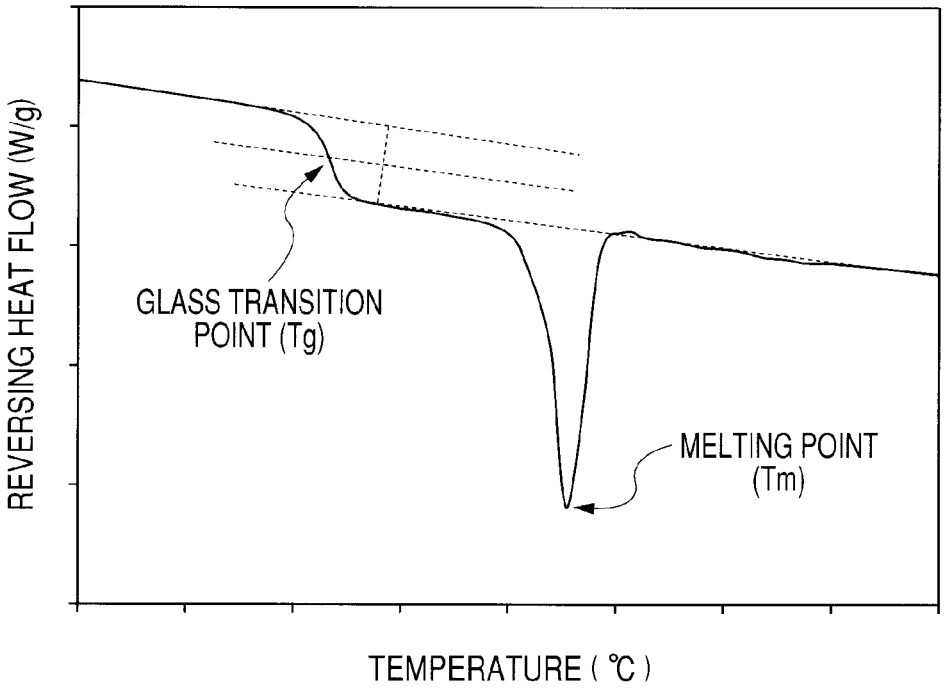
FIG. 2 is a graph showing a method for measuring a glass transition point (Tg) and a melting point (Tm) by DSC.

In the present invention, the glass transition points (Tg) and the melting points (Tm) of toner and the materials to be used herein are measured by a differential scanning calorimetric apparatus (DSC). As the DSC, Q1000 (manufactured by TA Instruments) can be used. The measurement method is as follows. A sample (about 6 mg) is weighed and placed in an aluminum pan. As a reference, a vacant aluminum pan is used. Measurement is performed under a nitrogen atmosphere, at a modulation variation of 1.0 C and at a frequency of 1/minute. The measurement temperature is set at 10° C., which is retained for 1 minute, and thereafter shifted from 10° C. to 200° C. at a temperature raising rate of 1° C./minute. The reversing heat-flow curve thus obtained is used to determine the Tg by the middle-point method. Note that the glass transition point obtained by the middle-point method is defined as follows. In the DSC curve at the time of temperature rise, base lines are drawn before and after the appearance of an endothermic peak. A middle line between the base lines is drawn. The intersection between the middle line and a rising curve is defined as the glass transition point (see FIG. 2).

The melting point of toner is measured in the same manner as above. In the reversing heat-flow curve obtained, the temperature at which a fusion peak takes a maximum value is determined as a melting point. Furthermore, the on-set value and off-set value of the melting point are obtained as follows. At the fusion peak, a tangent line is drawn to the point of the raising part of the peak and having a maximum inclination.

The extrapolation base line is drawn before the peak. The temperature at the intersection between the tangent line and the extrapolation base line is determined as the onset-value of the melting point. A tangent line is drawn to the point having a maximum inclination before completion of the melting peak. The extrapolation base line is drawn after the peak. The temperature at the intersection between the tangent line and the extrapolation base line is determined as the offset-value of the melting point.

The endothermic amount is obtained as follows. In the reversing heat-flow curve obtained by the aforementioned measurement, the linear line is drawn so as to connect a point, at which the peak rises from the extrapolation base line before the fusion peak, to a point, at which the extrapolation base line after completion of the fusion peak is in contact with the peak. Based on the area surrounded by this line and the fusion peak, the endothermic amount is obtained.

<Measurement of Loss Tangent (tan δ) Curve and Storage Elastic Modulus (G') Curve by Dynamic Viscoelasticity Test>

In the present invention, a method of measuring a storage elastic modulus (G') by the dynamic viscoelasticity test will be described.

As the measuring apparatus, for example, ARES (manufactured by Rheometic Scientific F, E) can be used. The storage elastic modulus is measured in the following conditions and within the temperature range of 25 to 200° C.

Measuring tool: Disk-form parallel plates of 8 mm in diameter

Measuring sample: Toner (0.12×ρ where ρ (g/cm$^3$) is a true density of toner) is weighed. A load of 20 kN is applied for 2 minutes to form a disk of 8 mm in diameter and a thickness of about 1 mm. This is used as a measuring sample.

Measuring frequency: 6.28 radian/second

Setting of strain for measurement: After an initial value is set at 0.1%, measurement is performed at an automatic measurement mode Correction of sample elongation: Corrected at an automatic measurement mode Measurement temperature: Elastic modulus is measured at intervals of 30 seconds at a temperature raising rate of 1° C./minute from 25 to 200° C.

<Measurement of Molecular Weight in Terms of Polystyrene by GPC>

A method of measuring a molecular weight in terms of polystyrene (PSt) by gel permeation chromatography (GPC) in the present invention will be described.

A column is stabilized in a heat chamber of 40° C. To the column at the same temperature, THF (tetrahydrofuran) is supplied as a solvent at a flow rate of 1 ml/minute and a THF sample solution (100 μl) is injected to perform measurement. In measuring the molecular weight of a sample, the molecular weight distribution of the sample is calculated based on the relationship between a logarithmic value and a count number of the calibration curve prepared by several types of monodisperse polystyrene standard samples. As the standard polystyrene sample for preparing the calibration curve, polystyrene having a molecular weight of about $10^2$ to $10^7$ is used and at least about 10 standard polystyrene samples are appropriately used. More specifically, standard polystyrene Easical PS-1 (a mixture of polystyrenes having a molecular weight of 7500000, 841700, 148000, 28500 and 2930, and a mixture of polystyrenes having a molecular weight of 2560000, 320000, 59500, 9920 and 580); and PS-2 (a mixture of polystyrenes having a molecular weight of 377400, 96000, 19720, 4490 and 1180, and a mixture of polystyrenes having a molecular weight of 188700, 46500, 9920, 2360 and 580) manufactured by Polymer Laboratories may be used in combination. As the detector, an RI (refractive index) detector is used. As the column, a plurality of commercially available polystyrene gel columns are preferably used in combination. For example, a combination of shodex GPC KF-801, 802, 803, 804, 805, 806, 807, 800P manufactured by Showa Denko K.K. and a combination of TSK gel G1000H (HXL), G2000H (HXL), G3000H (HXL), G4000H (HXL), G5000H (HXL), G6000H (HXL), G7000H (HXL), and TSK guard column manufactured by Tosoh Corporation may be mentioned.

A maximum value (Mp) of the molecular weight distribution of a THF soluble component of the toner of the present invention and a weight average molecular weight (Mw) are obtained from the molecular weight distribution obtained in the aforementioned measurement.

The sample used in GPC apparatus is prepared as follows.

The sample to be measured is added to THF, sufficiently mixed, and allowed to stand still for 18 hours. Thereafter, the sample is passed through a sample treatment filter (pore size: 0.45 to 0.5 μm, for example, Myshori disk H-25-5 (manufactured by Tosoh Corporation) and Ekikuro disk 25CR (manufactured by German Science Japan) to prepare a sample for GPC. The concentration of the sample to be measured relative to THF is 5 mg/ml.

The weight average molecular weights (Mw) and the number average molecular weights (Mn) of the wax and other resins to be used in the present invention can be measured in the same manner as above.

<Measurement of Acid Value of Resin>

The acid value of a resin can be obtained as follows. The basic operation is performed in accordance with JIS-K0070.

The amount (mg) of potassium hydroxide required for neutralizing a free fatty acid and a resin acid contained in a sample (1 g) is referred to as an acid value, which is measured by the following method.

(1) Reagent (a) Solvent Preparation

As the solvent for a sample, an ethyl ether-ethyl alcohol mixed solution (1+1 or 2+1) or a benzene-ethyl alcohol mixed solution (1+1 or 2+1) is used. These solutions are neutralized with a 0.1 mol/liter solution of potassium hydroxide in ethyl alcohol by using phenolphthalein as an indicator just before use.

(b) Preparation of a Phenolphthalein Solution

Phenolphthalein (1 g) is dissolved in 100 ml of ethyl alcohol (95 v/v %).

(c) Preparation of a 0.1 Mol/Liter Solution of Potassium Hydroxide in Ethyl Alcohol Potassium hydroxide (7.0 g) is dissolved in as a small amount of water as possible and ethyl alcohol (95 v/v %) is added up to 1 liter. After the solution is allowed to stand alone for 2 to 3 days, it is filtrated. Standardization is performed in accordance with JISK 8006 (A basic matter about the titration in the content check of a reagent).

(2) Operation

A sample (1 to 20 g) is accurately weighed. To the sample, a solvent (100 ml) and several drops of a phenolphthalein solution serving as an indicator are added. The resultant solution is shaken well until the sample is completely dissolved. In the case of a solid sample, the sample is dissolved in a water bath by heating. After cooling, the sample is titrated with a 0.1 mol/liter solution of potassium hydroxide in ethyl alcohol. If light pink color of the indicator lasts for 30 seconds, the time point is determined as a neutralization termination point.

(3) Calculation Formula

An acid value is calculated in accordance with the following formula:

$$A=B\times f\times 5.611/S$$

where

A: acid value (mg KOH/g);

B: use amount (ml) of a 0.1 mol/liter solution of potassium hydroxide in ethyl alcohol;

f: factor of a 0.1 mol/liter solution of potassium hydroxide in ethyl alcohol;

S: Sample (g).

<Measurement of Weight Average Particle Size ($D4_1$) and Number Average Particle Size ($D1_1$) of Toner>

The values of the weight average particle size ($D4_1$) and number average particle size ($D1_1$) can be measured specifically by the following method.

The weight average particle size ($D4_1$) and number average particle size ($D1_1$) are calculated as follows. As a measuring apparatus, an accurate particle-size distribution measuring apparatus "Coulter counter Multisizer 3" (registered trademark, manufactured by Beckman Coulter Corporation) equipped with a 100 μm aperture tube is used. This apparatus employs the pore electric resistance method. Setting of the measurement conditions and analysis of the measurement data are performed by special software "Beckman Coulter Multisizer 3 Version 3.51" (manufactured by Beckman Coulter Corporation) attached to the apparatus. Note that measurement is performed at an effectiveness measurement channel No. 25,000.

The aqueous electrolytic solution for use in measurement is prepared by dissolving special-grade sodium chloride in ion exchange water up to a concentration of about 1% by mass. For example "ISOTON II (manufactured by Beckman Coulter Corporation) can be used.

Note that before measurement and analysis are performed, special software is set as shown below.

In the "change standard measurement method (SOM)" screen, of the special software, the total count number of a control mode is set at 50,000 particles and the number of measurement times is set at 1. The Kd value is set at a value obtained by using a "standard particle of 10.0 μm" (manufactured by Beckman Coulter Corporation). When the "threshold/noise level measurement button" is pressed, a threshold value and noise level are automatically set. Furthermore, the current is set at 1,600 μA, gain at 2 and the electrolytic solution is set at ISOTON II. A check mark is put to "flash of an aperture tube after measurement".

In the "setting of conversion from pulse to particle size" screen of the special software, the intervals of bins are set at a logarithmic particle size, the particle-size bin is set at a 256 particle-size bin, and the particle size range is set at 2 μm to 60 μm.

Specific measurement method is as follows.

(1) To a round-bottom 250 ml-glass beaker special for Multisizer 3, about 200 ml of the aqueous electrolytic solution is placed. The beaker is set at a sample stand. Stirring is performed by use of a stirrer rod in a counterclockwise direction at 24 rounds/second. The contaminants and air bubbles in the aperture tube are previously removed by the function of the special software, "flash of aperture".

(2) In a 100-ml flat-bottom glass beaker, about 30 ml of the aqueous electrolytic solution is placed. On the other hand, "Contaminon N" (a 10% by mass aqueous solution (pH 7.0) of a neutral detergent for washing an accurate measurement apparatus, composed of a nonionic surfactant, an anionic surfactant and an organic builder, manufactured by Wako Pure Chemical Industries) is diluted to about 3 fold by mass with ion exchange water to prepare a dilution solution. The dilution solution (about 0.3 ml) is added to the beaker as a dispersant.

(3) An ultrasonic distributor, Ultrasonic Dispersion System tetora 150 (manufactured by Nikkaki Bios), having an electric power of 120 W and housing two oscillators having an oscillation frequency of 50 kHz in such a manner that the phases are shifted by 180° is prepared. In the water vessel of the ultrasonic distributor, about 3.3 liter of ion exchange water is poured and Contaminon N (about 2 ml) is added to the water vessel.

(4) The beaker (2) is set at a beaker fixing hole of the ultrasonic dispersion system and the ultrasonic distributor is actuated. The location of the beaker in the vertical direction is adjusted such that the resonance state of the liquid surface of the aqueous electrolytic solution in the beaker reaches a maximum.

(5) While the aqueous electrolytic solution in the beaker (4) is irradiated with ultrasonic wave, toner (about 10 mg) is added little by little to the aqueous electrolytic solution and dispersed. Then, the treatment by the ultrasonic distributor is continued for further 60 seconds. Note that, in the ultrasonic dispersion treatment, the water temperature of the water vessel is appropriately controlled so as to fall within the range of not less than 10 C to not more than 40° C.

(6) In the round-bottom beaker (1) placed in a sample stand, the aqueous electrolytic solution (5) having toner dispersed therein is added dropwise by use of a pipette and the concentration of the solution is controlled to be about 5% for measurement. Measurement is performed until the number of measured particles reaches 50,000.

(7) Measurement data is analyzed by the aforementioned special software attached to the apparatus to obtain a weight average particle size ($D4_1$) and number average particle size ($D1_1$) by calculation. Note that when a graph/volume % is set in the special software, the "average size" in the "analysis/volume statistic value (arithmetic average)" screen is a weight average particle size ($D4_1$)", whereas when a graph/number % is set in the special software, the "average size" in the "analysis/number statistic value (arithmetic average)" screen is a number average particle size ($D1_1$)".

<Measurement of Sulfur Element Content Derived From a sulfonic acid group of THF soluble component, Content of the Sulfonic Acid Group of Resin for Shell, and Contents of Silica and Titanium Oxide Contained in Toner>

Measurement is performed by use of a wavelength dispersion type fluorescent X-ray "Axios advanced" (manufactured by PANalytical). A sample (about 3 g) is placed in a 27-mm measurement ring made of vinyl chloride and then molded by pressing it at 200 kN to prepare a sample. The amount of the sample used herein and the thickness of the sample obtained by molding were measured. The aforementioned contents were determined as an input value for use in calculation of the contents. The analysis conditions and interpretation conditions are shown below.

Analysis Conditions

Quantitative Determination method: Fundamental parameter method

Element analyzed: Elements from boron B to uranium U in the periodical table are measured Atmosphere for measurement: Vacuum Measuring sample: Solid Diameter of collimator mask: 27 mm Measurement conditions: An automatic program previously set at optimum excitation conditions for each element was used Measurement time: about 20 minutes Others: General values recommended for the apparatus were used Interpretation Interpretation program: UniQuant 5

Interpretation conditions: Oxide form

Component for balance: $CH_2$

Others: General values recommended for the apparatus were used.

<Measurement of True Density of Toner and Carrier>

The true density of the toner and carrier can be measured by a method using a gas displacement pycnometer. The measurement principle is as follows. A blocking valve is provided between a sample chamber having a constant volume (volume $V_1$) and a comparative chamber having a constant volume (volume $V_2$). A sample is introduced into the sample chamber after the mass ($M_0$ (g)) of the sample is measured in advance. The sample chamber and the comparative chamber are filled with an inert gas such as helium. The pressure at this time is represented by $P_1$. The blocking value is closed and an inert gas is added only to the sample chamber. The pressure at this time is represented by $P_2$. The blocking valve is opened to allow the sample chamber to communicate with the comparative chamber. The pressure of the system at this time is represented by $P_3$. The volume of the sample (volume $V_0$ ($cm^3$)) can be obtained in accordance with expression A below. The true density ρ ($g/cm^3$) of the toner and carrier can be obtained in accordance with expression B below:

$$V_0=V_1-[V_2/\{(P_2-P_1)/(P_3-P_1)-1\}] \quad \text{(Expression A)}$$

$$\rho=M_0/V_0 \quad \text{(Expression B).}$$

The aforementioned measurement method was performed by use of a dry-type automatic densitometer, ACCUPYC 1330 (manufactured by Shimadzu Corporation) in the present invention. At this time, a 10-cm sample container is used. As a pretreatment for the sample container, helium gas purge is performed ten times at a maximum pressure of 19.5 psig (134.4 kPa). Thereafter, whether the pressure of the container reached equilibrium or not is determined based on a pressure equilibrium determination value, that is, swing of pressure of the sample chamber being 0.0050 psig/min. If the swing of pressure is equal to or less than this value, the chamber is regarded to reach the equilibrium state. Then, measurement is initiated and the true density is automatically measured. Measurement is repeated five times. The average of the measurement values is obtained and regarded as a true density ($g/cm^3$).

<Measurement of Zeta Potential of Color Particles and Resin Microparticles>

The zeta potentials of color particles and resin microparticles can be measured by a laser Doppler electrophoresis zeta potential measuring apparatus, more specifically, by use of zetasizer Nano ZS (model: ZEN 3600, manufactured by Malvern Instruments Ltd.).

Color particles or resin microparticles are controlled by ion exchange water so as to have a solid-substance content of 0.05% by mass. The pH of them is controlled to 7.0 by hydrochloric acid or sodium hydroxide. This dispersion solution (20 ml) is dispersed by an ultrasonic cleaner (BRANSONIC 3510 manufactured by BRANSON) for 3 minutes. The zeta potential (mV) is measured by using this in accordance with the method recommended by the manual except for the following conditions. The zeta potential of the color particles is expressed by $Z_2$ (mV) and the zeta potential of the resin microparticles is expressed by $Z_{1s}$ (mV).

Cell: DTS 1060C-Clear disposable zeta cell

Dispersant: water

Measurement duration: Automatic

Model: Smoluchowski

Temperature: 25.0° C.

Result Calculation: General Purpose

Furthermore, the integral curve of a distribution curve of the zeta potential [(Zeta Potential (mV)(x-axis)-Intensity (kcps) (y-axis) curve)] obtained in the above measurement is obtained. The y-axis is converted to percentage to form a Zeta Potential (mV) (x-axis)-percentage (%) of integral value (y-axis) curve. From this curve, the value of the x-axis corresponding to the value (10%) of the y-axis is read off and represented by $Z_{s10}$ (mV). The value of the x-axis when the value of the y-axis is 90.0% is read off and represented by $Z_{s90}$ (mV).

EXAMPLES

The present invention will be more specifically described by way of Production Examples and Examples which should not be construed as limiting the present invention.

Production Examples 1 for Surface-Layer Resin

In a reaction container equipped with a cooling tube, a stirrer and a nitrogen-inlet tube, the materials described below were placed. The reaction was carried out under normal pressure at 260° C. for 8 hours. Thereafter, the reaction mixture was cooled to 240° C. and reduced in pressure for one hour to 1 mmHg. The reaction mixture was further reacted for 3 hours to obtain polyester having a sulfonic acid group.

(Alcohol Monomer)

Polyoxypropylene(2.2)-2,2-bis(4-hydroxyphenyl)propane (BPA-PO): 35 mol % (120 parts by mass)

Polyoxyethylene(2.2)-2,2-bis(4-hydroxyphenyl)propane (BPA-EO): 10 mol % (32 parts by mass)

Ethylene glycol: 70 mol % (43 parts by mass) (Acid monomer)

Terephthalic acid: 64 mol % (106 parts by mass)

Isophthalic acid: 30 mol % (58 parts by mass)

Trimellitic acid anhydride: 6 mol % (13 parts by mass)

5-sodium sulfoisophthalate: 4.8 mol % (10 parts by mass) (Catalyst)

Tetrabutyl titanate 0.1 mol % (0.28 parts by mass)

To a reaction container equipped with a cooling tube, a stirrer and a nitrogen-inlet tube, the polyester mentioned above (100 parts by mass), methylethyl ketone (50 parts by mass) and tetrahydrofuran (50 parts by mass) were added. The reaction mixture was heated to 75° C. while stirring. To this, water (300 parts by mass) of 75° C. was added and stirred for one hour. The reaction mixture was heated to 90° C. and stirred at this temperature for 3 hours and stirred at 95° C. for 2 hours, and then cooled to 30° C. to obtain a microparticle dispersion solution containing a surface-layer resin 1. The formulation is shown in Table 1 and physical properties are shown in Table 2.

Production Example 2 to 5 for Surface-Layer Resin

The microparticle dispersion solutions containing surface-layer resins 2 to 5 were obtained in the same manner as in Production Example 1 for a surface-layer resin except for the formulations shown in Table 1. The physical properties thereof are shown in Table 2.

TABLE 1

| Production Example for surface-layer resin | Alcohol monomer | | | Acid monomer | | | |
|---|---|---|---|---|---|---|---|
| | BPA-PO | BPA-EO | Ethylene glycol | Terephthalic acid | Isophthalic acid | Trimellitic acid anhydride | 5-sodium sulfoiso-phthalate |
| Production Example 1 for surface-layer resin | 35 mol % (120 parts by mass) | 10 mol % (32 parts by mass) | 70 mol % (43 parts by mass) | 64 mol % (106 parts by mass) | 30 mol % (58 parts by mass) | 6 mol % (13 parts by mass) | 4.8 mol % (10 parts by mass) |
| Production Example 2 for surface-layer resin | 30 mol % (103 parts by mass) | 10 mol % (32 parts by mass) | 80 mol % (50 parts by mass) | 57 mol % (95 parts by mass) | 40 mol % (77 parts by mass) | 3 mol % (6 parts by mass) | 4.2 mol % (8 parts by mass) |
| Production Example 3 for surface-layer resin | 30 mol % (103 parts by mass) | 20 mol % (63 parts by mass) | 55 mol % (34 parts by mass) | 74 mol % (123 parts by mass) | 18 mol % (35 parts by mass) | 8 mol % (17 parts by mass) | 7.6 mol % (15 parts by mass) |
| Production Example 4 for surface-layer resin | 30 mol % (103 parts by mass) | 10 mol % (32 parts by mass) | 80 mol % (50 parts by mass) | 40 mol % (66 parts by mass) | 60 mol % (115 parts by mass) | — | — |
| Production Example 5 for surface-layer resin | 30 mol % (103 parts by mass) | 20 mol % (63 parts by mass) | 55 mol % (34 parts by mass) | 92 mol % (153 parts by mass) | — | 8 mol % (17 parts by mass) | 10.4 mol % (21 parts by mass) |

TABLE 2

| Surface-layer resin | Ts (° C.) | $G'_{10}$ (Pa) | $G'_{20}$ (Pa) | $G'_{10}/G'_{20}$ | $Dv_S$ (nm) | $Dv_S/Dv_{S10}$ | $Dv_{S20}/Dv_S$ | Acid value $Av_S$ (mgKOH/g) | $Av_s \times Dv_S$ | Zeta potential $Z_{1S}$ (mV) | $Z_{1S}/Z_{S10}$ | $Z_{S90}/Z_{1S}$ |
|---|---|---|---|---|---|---|---|---|---|---|---|---|
| Surface-layer resin 1 | 81.2 | $1.2 \times 10^6$ | $4.3 \times 10^5$ | 2.9 | 27.4 | 1.7 | 1.8 | 12.1 | 332 | −71.4 | 1.21 | 1.12 |
| Surface-layer resin 2 | 73.1 | $8.4 \times 10^5$ | $9.2 \times 10^4$ | 9.1 | 67.1 | 2.4 | 1.8 | 8.1 | 544 | −65.6 | 1.82 | 1.42 |
| Surface-layer resin 3 | 94.1 | $7.2 \times 10^5$ | $1.9 \times 10^5$ | 3.8 | 18.6 | 4.7 | 3.9 | 22.8 | 424 | −82.7 | 2.44 | 2.16 |
| Surface-layer resin 4 | 72.1 | $4.8 \times 10^5$ | $3.4 \times 10^4$ | 14.0 | 108.2 | 11.3 | 5.4 | 1.7 | 184 | −46.1 | 3.25 | 2.58 |
| Surface-layer resin 5 | 95.2 | $3.3 \times 10^6$ | $1.5 \times 10^6$ | 2.2 | 17.1 | 6.8 | 10.8 | 36.1 | 617 | −93.3 | 2.89 | 3.07 |

Production Example for Polar Resin

In a reaction container equipped with a cooling tube, a stirrer and a nitrogen-inlet tube, the materials described below were placed. The reaction was carried out under normal pressure at 260° C. for 8 hours. Thereafter, the reaction mixture was cooled to 240° C. and reduced in pressure for one hour to 1 mmHg. The reaction mixture was further reacted for 3 hours to obtain a polar resin.

(Alcohol Monomer)

Polyoxypropylene(2.2)-2,2-bis(4-hydroxyphenyl)propane (BPA-PO): 35 mol % (120 parts by mass)

Polyoxyethylene(2.2)-2,2-bis(4-hydroxyphenyl)propane (BPA-EO): 10 mol % (32 parts by mass)

Ethylene glycol: 70 mol % (43 parts by mass)

(Acid monomer)

Terephthalic acid: 64 mol % (106 parts by mass)

Isophthalic acid: 30 mol % (58 parts by mass)

Trimellitic acid anhydride: 6 mol % (13 parts by mass)

(Catalyst)

Tetrabutyl titanate 0.1 mol % (0.28 parts by mass)

The obtained polar resin was checked for physical properties in the same manner as in the surface-layer resins. Peak temperature $T_s$ of tan δ (measured by dynamic viscoelasticity measurement) was 76.1° C.; $G'_{10}$ was $5.1 \times 10^5$ Pa; $G'_{30}$ was $6.7 \times 10^4$ Pa; and $G'_{10}/G'_{30}$ was 7.6. The acid value was 5.3 mg KOH/g.

Production Example 1 of a Dispersion Solution of Color Particles

A monomer mixture was prepared which consists of:

| | |
|---|---|
| Styrene | 65 parts by mass |
| N-butyl acrylate | 35 parts by mass |
| Pigment blue 15:3 | 6 parts by mass |
| A aluminum salicylate compound (BONTRON E-88: manufactured by Orient Chemical Industries Ltd.) | 1 part by mass |
| Divinylbenzene | 0.022 parts by mass |
| Polar resin obtained in aforementioned Production Example for polar resin | 3.0 parts by mass |
| Fischer Tropsch wax (Melting point: 78° C., half width of melting point: 3.5° C.). | 10 parts by mass |

To the mixture, 15-mm ceramic beads were added and dispersed by use of an attritor for 2 hours to obtain a monomer composition.

To ion exchange water (700 parts by mass), a 0.1 mol/liter aqueous $Na_3PO_4$ solution (450 parts by mass) was added and heated to 60° C. The mixture was stirred by use of TK homomixer (manufactured by Tokushu Kika Kogyo) at 10,000 rpm. To the mixture, a 1.0 mol/liter aqueous $CaCl_2$ solution (68 parts by mass) was added to obtain a water dispersion solution containing calcium phosphate.

To the above monomer composition, a 70% toluene solution of 1,1,3,3-tetramethylbutylperoxyl-2-ethylhexnoate (10 parts by mass) serving as a polymerization initiator was added. The resultant mixture was added to the above dispersion system. A granulation process was performed by the high-speed stirring apparatus for 3 minutes while keeping 12000 rounds/minute. Thereafter, a propeller agitation vane was used in place of the stirrer used in the high-speed stirring apparatus and polymerization was performed for 10 hours at 150 rounds/minute. The resultant product was cooled to 50° C. to obtain a color particle dispersion solution 1.

Production Examples 2 and 3 for Color Particle Dispersion Solution

Color particle dispersion solutions 2 and 3 were obtained in the same manner as in Production Example 1 for a color particle dispersion solution except that the addition amounts of materials were changed as shown in Table 3.

TABLE 3

| Production Example for color particle dispersion solution | Color particle | Addition amount of aqueous $Na_3PO_4$ solution (parts by mass) | Addition amount of aqueous $CaCl_2$ solution (parts by mass) | Addition amount of styrene (parts by mass) | Addition amount of n-butyl acrylate (parts by mass) | Addition amount of polymerization initiator (parts by mass) | $T_2$ (° C.) | Zeta potential $Z_{2C}$ (mV) |
|---|---|---|---|---|---|---|---|---|
| Production Example 1 for color particle dispersion solution | Color particle dispersion solution 1 | 450 | 68 | 65 | 35 | 10 | 43 | −42.2 |
| Production Example 2 for color particle dispersion solution | Color particle dispersion solution 2 | 475 | 72 | 70 | 30 | 12 | 53 | −43.1 |
| Production Example 3 for color particle dispersion solution | Color particle dispersion solution 3 | 425 | 64 | 60 | 40 | 7.5 | 34 | −41.9 |

Example 1

To a reaction container equipped with a cooling tube, a stirrer and a nitrogen-inlet tube, the following solutions were added to obtain a dispersion solution mixture:

Color particle dispersion solution 1 (obtained above):

1380 parts by mass (Content of color particles: 100 parts by mass)

Microparticle dispersion solution containing surface-layer resin 1:

20 parts by mass (Content of surface-layer resin: 5 parts by mass).

The above dispersion solution mixture was heated to $T_2$+15 (° C.) and stirred for 3 hours (heating step 1). Subsequently, 0.2 mol/liter hydrochloric acid was added dropwise for 3 hours to adjust the pH of the reaction system to 1.8 (acid treatment step). Furthermore, the dispersion solution mixture was heated to $T_s$ (of surface-layer resin 1) −10(° C.) and stirred continuously for one hour (heating step 2). The resultant mixture was cooled to 20° C., filtrated and dried to obtain toner particle 1.

A mixture was prepared consisting of:

Toner particle 1 (mentioned above): 100 parts by mass

Hydrophobic titanium oxide treated with n-$C_4H_9Si(OCH_3)_3$ (BET specific surface area: 130 $m^2/g$):

1 part by mass

Hydrophobic silica treated with hexamethyldisilazane and then treated with silicone oil (BET specific surface area: 160 $m^2/g$) 1 part by mass.

The mixture was stirred by Henschel mixer to obtain toner 1. The formulation and conditions for producing toner 1 are shown in Table 4.

Toner 1 was evaluated for the following items. Physical properties of toner 1 are shown in Tables 5 and 6 and evaluation results are shown in Table 7.

Examples 2 to 6

Toners 2 to 6 were obtained in the same manner as in Example 1 except that the use amounts of raw materials, the conditions of heating step 1, acid treatment step, and heating step 2 were changed to those shown in Table 4. The toners 2 to 6 were evaluated in the same manner as in Example 1. The physical properties of individual toners are shown in Tables 5 and 6 and the evaluation results are shown in Table 7.

Comparative Example 1

Toner 7 was obtained in the same manner as in Example 1 except that use amounts of raw materials, the conditions of heating step 1 and acid treatment step were changed to those shown in Table 4 and heating step 2 was not performed. The toner 7 was evaluated in the same manner as in Example 1. The physical properties of the toner 7 are shown in Tables 5 and 6 and the evaluation results are shown in Table 7.

Comparative Examples 2 and 3

Toners 8 and 9 were obtained in the same manner as in Example 1 except that the use amounts of raw materials, the conditions of heating step 1, acid treatment step and heating step 2 were changed to those shown in Table 4. The toners 8 and 9 were evaluated in the same manner as in Example 1. The physical properties of the toners 8 and 9 are shown in Tables 5 and 6 and the evaluation results are shown in Table 7.

Comparative Example 4

Toner 10 was obtained in the same manner as in Example 1 except that use amounts of raw materials, the conditions of heating step 1 and heating step 2 were changed to those shown in Table 4 and the acid treatment step was not performed. The toner 10 was evaluated in the same manner as in Example 1.

The physical properties of the toner 10 are shown in Tables 5 and 6 and the evaluation results are shown in Table 7.

Comparative Example 5

A color particle dispersion solution was obtained in the same manner as in Production Example 1 for a color particle dispersion solution except that the addition amount of polar resin was changed to 10 parts by mass. Toner 11 was obtained in the same manner as in Example 1 except that this color particle dispersion solution was used and a surface layer resin was not added. The toner 11 was evaluated in the same manner as in Example 1. The physical properties of the toner 11 are shown in Tables 5 and 6 and the evaluation results are shown in Table 7.

Comparative Example 6

Toner 12 was obtained in the same manner as in Comparative Example 5 except that the addition amount of polar resin was changed to 30 parts by mass. The toner 12 was evaluated in the same manner as in Example 1. The physical properties of the toner 12 are shown in Tables 5 and 6 and the evaluation results are shown in Table 7.

TABLE 4

| | Toner | Color particle dispersion solution | Surface-layer resin | Addition amount (parts by mass) of surface-layer resin (left) relative to 100 parts by mass of color particles | Heating step 1 Heating temperature (° C.) | T2 (° C.) | Stirring (hours) |
|---|---|---|---|---|---|---|---|
| Ex. 1 | Toner 1 | Color particle dispersion solution 1 | Surface-layer resin 1 | 5 | $T_2 + 15$ | 43 | 3 |
| Ex. 2 | Toner 2 | Color particle dispersion solution 1 | Surface-layer resin 2 | 5 | $T_2 + 15$ | 43 | 3 |
| Ex. 3 | Toner 3 | Color particle dispersion solution 1 | Surface-layer resin 3 | 5 | $T_2 + 15$ | 43 | 3 |
| Ex. 4 | Toner 4 | Color particle dispersion solution 2 | Surface-layer resin 3 | 3 | $T_2 + 5$ | 53 | 3 |
| Ex. 5 | Toner 5 | Color particle dispersion solution 3 | Surface-layer resin 1 | 8 | $T_2 + 15$ | 34 | 3 |
| Ex. 6 | Toner 6 | Color particle dispersion solution 3 | Surface-layer resin 2 | 8 | $T_2 + 5$ | 34 | 3 |
| Com. Ex. 1 | Toner 7 | Color particle dispersion solution 1 | Surface-layer resin 2 | 8 | $T_2$ | 43 | 1 |
| Com. Ex. 2 | Toner 8 | Color particle dispersion solution 2 | Surface-layer resin 5 | 8 | $T_2 + 5$ | 53 | 3 |
| Com. Ex. 3 | Toner 9 | Color particle dispersion solution 3 | Surface-layer resin 4 | 3 | $T_2 + 5$ | 34 | 3 |
| Com. Ex. 4 | Toner 10 | Color particle dispersion solution 1 | Surface-layer resin 3 | 8 | $T_2 + 15$ | 43 | 3 |
| Com. Ex. 5 | Toner 11 | — | Polar resin obtained in Production Example for polar resin | 10 | $T_2 + 15$ | 44 | 3 |
| Com. Ex. 6 | Toner 12 | — | Polar resin obtained in Production Example for polar resin | 30 | $T_2 + 15$ | 46 | 3 |

| | Acid treatment step Concentration (mol/liter) of hydrochloric acid | Time for dropwise addition (hours) | pH after dropwise addition | Heating step 2 Heating temperature | Ts (° C.) | Stirring time (hours) |
|---|---|---|---|---|---|---|
| Ex. 1 | 0.2 | 3 | 1.8 | $T_s - 10$ | 81.2 | 1 |
| Ex. 2 | 0.2 | 3 | 1.8 | $T_s - 10$ | 73.1 | 1 |
| Ex. 3 | 0.2 | 3 | 1.8 | $T_s - 10$ | 94.1 | 1 |
| Ex. 4 | 0.5 | 1 | 1.8 | $T_s - 20$ | 94.1 | 1 |
| Ex. 5 | 0.2 | 3 | 1.8 | $T_s - 10$ | 81.2 | 1 |
| Ex. 6 | 0.5 | 1 | 1.8 | $T_s - 20$ | 73.1 | 1 |
| Com. Ex. 1 | 0.5 | 1 | 1.8 | — | — | — |
| Com. Ex. 2 | 0.5 | 1 | 1.8 | $T_s - 20$ | 95.2 | 1 |
| Com. Ex. 3 | 0.5 | 1 | 1.8 | $T_s - 20$ | 72.1 | 1 |
| Com. | — | — | — | $T_s - 10$ | 94.1 | 1 |

TABLE 4-continued

| | | | | | | | |
|---|---|---|---|---|---|---|---|
| | Ex. 4 | | | | | | |
| | Com. Ex. 5 | 0.2 | 3 | 1.8 | $T_s - 10$ | 66.8 | 1 |
| | Com. Ex. 6 | 0.2 | 3 | 1.8 | $T_s - 10$ | 66.8 | 1 |

TABLE 5

| Example | Toner | $D4_T$ (μm) | $D1_T$ (μm) | Tg of Toner by DSC ($T_1$ (° C.)) | Mw of THF soluble component | Mw/Mn of THF soluble component | Content of THF soluble component (% by mass) | Sulfur content of THF soluble component (% by mass) |
|---|---|---|---|---|---|---|---|---|
| Ex. 1 | Toner 1 | 5.3 | 4.9 | 44 | 97200 | 5.20 | 86.1 | 0.113 |
| Ex. 2 | Toner 2 | 5.2 | 4.8 | 44 | 96600 | 5.19 | 84.5 | 0.098 |
| Ex. 3 | Toner 3 | 5.2 | 4.6 | 44 | 98100 | 5.22 | 87.2 | 0.201 |
| Ex. 4 | Toner 4 | 4.6 | 3.9 | 54 | 54800 | 3.19 | 88.4 | 0.117 |
| Ex. 5 | Toner 5 | 6.2 | 5.3 | 34 | 137200 | 7.18 | 82.6 | 0.181 |
| Ex. 6 | Toner 6 | 6.6 | 5.5 | 34 | 136700 | 7.23 | 81.3 | 0.151 |
| Com. Ex. 1 | Toner 7 | 5.6 | 4.6 | 44 | 96500 | 5.19 | 82.9 | 0.116 |
| Com. Ex. 2 | Toner 8 | 5.1 | 4.3 | 54 | 54400 | 3.14 | 78.7 | 0.374 |
| Com. Ex. 3 | Toner 9 | 7.1 | 6.0 | 34 | 136100 | 7.52 | 91.2 | 0.000 |
| Com. Ex. 4 | Toner 10 | 5.6 | 4.8 | 44 | 95800 | 5.04 | 85.2 | 0.321 |
| Com. Ex. 5 | Toner 11 | 6.2 | 5.1 | 46 | 91200 | 4.47 | 84.3 | 0.000 |
| Com. Ex. 6 | Toner 12 | 7.6 | 6.1 | 38 | 132200 | 9.87 | 74.6 | 0.000 |

TABLE 6

| | Toner | $A_{80a}$ (%) | $S_{1a}/S_{2a}$ | $B_{10}$ (%) | ϕ (%) | α | $C_{10}$ | β | $S_{1b}/S_{1a}$ | $S_{2b}/S_{2a}$ |
|---|---|---|---|---|---|---|---|---|---|---|
| Ex. 1 | Toner 1 | 58 | 2.5 | 57 | 1.8 | −4.8 | $1.52\ 10^{-4}$ N (15.5 mgf) | 5.1 | 1.7 | 3.6 |
| Ex. 2 | Toner 2 | 61 | 2.3 | 59 | 3.4 | −5.6 | $1.25\ 10^{-4}$ N (12.7 mgf) | 6.0 | 2.6 | 4.7 |
| Ex. 3 | Toner 3 | 51 | 2.7 | 47 | 8.5 | −6.1 | $1.90\ 10^{-4}$ N (19.4 mgf) | 6.4 | 1.5 | 3.1 |
| Ex. 4 | Toner 4 | 44 | 1.9 | 41 | 7.3 | −6.2 | $2.58\ 10^{-4}$ N (26.3 mgf) | 6.6 | 1.4 | 2.8 |
| Ex. 5 | Toner 5 | 64 | 2.9 | 60 | 6.7 | −5.5 | $1.60\ 10^{-4}$ N (16.3 mgf) | 5.9 | 2.0 | 4.1 |
| Ex. 6 | Toner 6 | 67 | 1.6 | 63 | 6.3 | −7.7 | $1.04\ 10^{-4}$ N (10.6 mgf) | 8.3 | 1.3 | 2.1 |
| Com. Ex. 1 | Toner 7 | 54 | 0.6 | 47 | 14.9 | −17.2 | $8.44\ 10^{-5}$ N (8.6 mgf) | 16.8 | 2.4 | 4.1 |
| Com. Ex. 2 | Toner 8 | 34 | 1.2 | 29 | 17.2 | −12.8 | $3.44\ 10^{-4}$ N (35.1 mgf) | 13.3 | 1.1 | 1.8 |
| Com. Ex. 3 | Toner 9 | 77 | 1.4 | 69 | 11.6 | −10.4 | $9.52\ 10^{-5}$ N (9.7 mgf) | 3.8 | 1.3 | 1.9 |
| Com. Ex. 4 | Toner 10 | 37 | 3.7 | 34 | 10.1 | −9.2 | $3.65\ 10^{-4}$ N (37.2 mgf) | 8.5 | 3.2 | 6.3 |
| Com. Ex. 5 | Toner 11 | 53 | 0.8 | 49 | 9.3 | −8.7 | — | — | 1.6 | 3.8 |
| Com. Ex. 6 | Toner 12 | 47 | 1.3 | 43 | 10.3 | −11.6 | $5.13\ 10^{-4}$ N (52.3 mgf) | 15.7 | 1.1 | 1.6 |

<Evaluation Method for Anti-Blocking Performance>

Toner (5 g) was weighed in 100 ml plastic cups, and the cups were separately placed in a hot air drier adjusted at 50° C. and in a room adjusted at 25° C. and allowed to stand still for a week. The cups were gently taken out and slowly rotated. The toner stored at 50° C. and the toner stored at 25° C. were compared and visually evaluated for fluidity at the time of rotation.

A: The fluidity of toner stored at 50° C. is equivalent to that of toner stored at 25° C.

B: The fluidity of toner stored at 50° C. is slightly poor compared to that of toner stored at 25° C.; however it is gradually recovered with the passage of time of the poly cup rotation C: Aggregated and fused mass is observed in toner stored at 50° C.

D: The toner stored at 50° C. does not flow.

<Evaluation Method for Low-Temperature Fixing Performance, Anti-Off-Set Performance, Anti-Soaking Performance and Color Gamut Performance>

A commercially available color laser printer (LBP-5400, manufactured by Canon Inc.) was used. The toner was taken out from the cyan cartridge. The cyan cartridge was packed with toner 1. The cartridge was installed in the cyan station. On an image-receiving paper (64 g/m$^2$, office planner manufactured by Canon Inc.), a toner image (0.5 mg/cm$^2$) unfixed of 2.0 cm in length and 15.0 cm in width was formed at the portion at a distance of 2.0 cm from the upper edge and at the portion at a distance of 2.0 cm from the lower edge in a paper-moving direction. Subsequently, from the commercially available color laser printer (LBP-5400, manufactured by Canon Inc.), a fixing unit was removed. The fixing unit was modified in such a manner that a fixing temperature and a process speed can be controlled. Using this, a fixing test of the unfixed image was performed. Under normal temperature and normal humidity conditions, a process speed was set at 280 mm/second. While changing the temperature stepwise at the intervals of 10° C. within the range of 120° C. to 240° C., the above toner image was fixed at each temperature. The low-temperature fixing performance, anti-off-set performance, glossing performance and anti-soaking performance were evaluated in accordance with the following evaluation criteria:

Low-Temperature Fixing Performance

A: low-temperature offset does not occur at 120° C. or more and toner is not removed even if it is rubbed with a finger B: low-temperature offset does not occur at 130° C. or more and toner is not removed even if it is rubbed with a finger C: low-temperature offset does not occur at 140° C. or more and toner is not removed even if it is rubbed with a finger D: low-temperature offset does not occur at 150° C. or more and toner is not removed even if it is rubbed with a finger E: Poor than D.

Anti-Offset Performance

A: High-temperature offset does not occur in the temperature range of the temperature as a criterion for low-temperature fixing performance +70° C. or more B: High-temperature offset does not occur in the temperature range of the temperature as a criterion for low-temperature fixing performance +60° C. or more C: High-temperature offset does not occur in the temperature range of the temperature as a criterion for low-temperature fixing performance +50° C. or more D: High-temperature offset does not occur in the temperature range of the temperature as a criterion for low-temperature fixing performance +40° C. or more E: Poor than D.

Glossing Performance

A fixed image that has no low-temperature offset and high-temperature offset was measured for glossiness by use of a handy gloss meter-PG-3D (manufactured by Nippon Denshoku Industries Co., Ltd,) at a light incident angle of 75° and evaluated in accordance with the following criteria:

A: The uppermost value of glossiness of a solid image portion is 45 or more

B: The uppermost value of glossiness of a solid image portion is not less than 40 to less than 45

C: The uppermost value of glossiness of a solid image portion is not less than 35 to less than 40

D: The uppermost value of glossiness of a solid image portion is not less than 30 to less than 35

E: The uppermost value of glossiness of a solid image portion is less than 30.

Anti-Soaking Performance

In an image having the uppermost glossiness, the glossiness is represented by $t_1$. At the temperature of the fixing apparatus (when the above image was formed)+10° C., an image was formed. The glossiness of the image is represented by $t_2$. A change rate between $t_1$ and $t_2$ [change rate (%)=$(t_1-t_2)\times 100/t_1$] was evaluated in accordance with the following criteria:

A: Glossiness change rate is less than 5%

B: Glossiness change rate is not less than 5% to less than 10%

C: Glossiness change rate is not less than 10% to less than 15%

D: Glossiness change rate is not less than 15% to less than 20%

E: Glossiness change rate is 20% or more.

<Running Stability Performance>

A commercially available color laser printer (LBP-5400, manufactured by Canon Inc.) was used. Toner was taken out from the cyan cartridge. The cyan cartridge was packed with toner 1 (50 g). The cartridge was installed in the cyan station. On an image receiving paper (64 g/m$^2$, office planner manufactured by Canon Inc.), letters were printed continuously at a printing ratio of 1%. A solid image was formed at a rate of 1 sheet per 500 sheets. When the amount of toner in the cartridge reached 25 g or less, toner 1 (50 g) was added and continued to print in the same manner. Such an operation was repeated. Running stability performance was evaluated in accordance with the following criteria:

Running Stability Performance (1)

A: When the total addition amount of toner is 200 g or more, the density of a solid image is less than 1.5. Alternatively, when the total addition amount of toner is 250 g, the density of a solid image is not less than 1.5

B: When the total addition amount of toner is 150 g, the density of a solid image is less than 1.5

C: When the total addition amount of toner is 100 g, the density of a solid image is less than 1.5

D: When the total addition amount of toner is 50 g, the density of a solid image is less than 1.5

E: The density of a solid image is less than 1.5 without addition of toner.

Running Stability Performance (2)

A: When the total addition amount of toner is 200 g or more, an image having a printing rate of 1% has an image failure. Alternatively, when the total addition amount of toner is 250 g, no image failure occurs B: When the total addition amount of toner is 150 g, an image having a printing rate of 1% has an image failure C: When the total addition amount of toner is 100 g, an image having a printing rate of 1% has an image failure D: When the total addition amount of toner is 50 g, an image having a printing rate of 1% has an image failure E: An image having a printing rate of 1% has an image failure without addition of toner.

TABLE 7

| | Anti-blocking performance | Low-temperature fixing performance | Glossing performance | Anti-soaking performance | Running stability performance (1) | Running stability performance (2) |
|---|---|---|---|---|---|---|
| Ex. 1 | A | A | A | A | A | A |
| Ex. 2 | A | A | A | B | B | B |

TABLE 7-continued

| | Anti-blocking performance | Low-temperature fixing performance | Glossing performance | Anti-soaking performance | Running stability performance (1) | Running stability performance (2) |
|---|---|---|---|---|---|---|
| Ex. 3 | A | B | B | A | B | C |
| Ex. 4 | B | C | C | B | B | C |
| Ex. 5 | A | A | A | A | B | B |
| Ex. 6 | B | A | B | C | C | C |
| Com. Ex. 1 | D | A | A | B | D | D |
| Com. Ex. 2 | B | D | C | B | D | E |
| Com. Ex. 3 | C | A | C | D | C | D |
| Com. Ex. 4 | A | D | C | B | D | D |
| Com. Ex. 5 | C | A | B | C | C | D |
| Com. Ex. 6 | B | C | B | B | D | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims a priority form Japanese Patent Application No. 2008-042970 filed Feb. 25, 2008 and the content thereof is partly incorporated herein by reference.

What is claimed is:

1. A process for preparing a toner comprising the steps of:

(a) preparing toner particles each of which contains at least a binder resin, a colorant, and a wax, and has a coat layer on the surface thereof; and (b) adding an inorganic fine powder to the toner particles, wherein the step (a) comprises:

(i) providing a resin microparticle;

(ii) providing an aqueous medium containing a color particle and a sparingly water-soluble inorganic salt, wherein the color particle contains at least the binder resin, the colorant, and the wax;

(iii) forming a dispersion solution mixture by adding the resin microparticle to the aqueous medium; and (iv) immobilizing the resin microparticle to the color particle by:

heating the dispersion solution mixture to a temperature of not less than $T_2$ (° C.) and not more than $T_s$ (° C.), where $T_2$ (° C.) is the glass transition point of the color particle and $T_s$ (° C.) is the glass transition point of the resin microparticle;

adjusting a pH of the dispersion solution mixture to 5.0 or less to dissolve the sparingly water-soluble inorganic salt; and then heating the dispersion solution mixture to a temperature of not less than $T_2$ (° C.) and not more than Ts−30 (° C.) to Ts (° C.) or less, wherein the resin microparticle has a volume average particle size of 20.0 to 100.0 nm, wherein the resin microparticle has a zeta potential ($Z_{1s}$) of from −110.0 mV to −35.0 mV, and wherein the color particle has a zeta potential ($Z_{2c}$) of −15.0 mV or less, the zeta potential ($Z_{2c}$) satisfying the relationship: ($Z_{1s}$+5.0) to ($Z_{1s}$+50.0) mV.

2. A process for preparing a toner comprising the steps of:

(a) preparing toner particles each of which contains at least a binder resin, a colorant, and a wax, and has a coat layer on the surface thereof; and (b) adding an inorganic fine powder to the toner particles, wherein the step (a) comprises:

(i) providing an aqueous medium containing a color particle and a sparingly water-soluble inorganic salt, both of which are dispersed therein, the color particle containing at least the binder resin, the colorant, and the wax;

(ii) forming a dispersion solution mixture by adding a resin microparticle to the aqueous medium; and (iii) immobilizing the resin microparticle to the color particle by:

heating the dispersion solution mixture to a temperature of not less than $T_2$ (° C.) and not more than $T_s$ (° C.), where $T_2$ (° C.) is the glass transition point of the color particle and $T_s$ (° C.) is the glass transition point of the resin microparticle;

adjusting a pH of the dispersion solution mixture to 5.0 or less to dissolve the sparingly water-soluble inorganic salt; and then heating the dispersion solution mixture to a temperature of not less than $T_2$ (° C.) and not more than $T_s$−30 (° C.) to $T_s$ (° C.) or less, wherein the resin microparticle has a volume average particle size of 20.0 to 100.0 nm, wherein the resin microparticle has a zeta potential ($Z_{1s}$) of from −110.0 mV to −35.0 mV, wherein the color particle has a zeta potential ($Z_{2c}$) of −15.0 mV or less, the zeta potential ($Z_{2c}$) satisfying the relationship: ($Z_{1s}$+5.0) to ($Z_{1s}$+50.0) mV, and wherein, when the glass transition point of the toner measured by a differential scanning calorimeter (DSC) is represented by $T_1$ (° C.), in a micro compression test for the toner at $T_1$−10 (° C.), when a load from 0.00N (0.00 mgf) to $7.85\times10^{-4}$ N (80.00 mgf) is applied at the intervals of $7.85\times10^{-7}$ N (0.08 mgf) to a single particle of the toner, the strain value $A_{80a}$ (%) at $7.85\times10^{-4}$ N is 35.0 to 75.0%; and in a load (x-axis)-strain (y-axis) curve obtained by the micro compression test, the ratio of an area ($S_{1a}$) of a region, which is surrounded by the curve, a linear line of $x=7.85\times10^{-4}$ N and the x-axis, relative to an area ($S_{2a}$) of a region, which is surrounded by a linear line connecting a point on the curve at $x=3.92\times10^{-5}$ N (4.00 mgf) to a point on the curve at $x=7.85\times10^{-5}$ N (8.00 mgf), a linear line of $x=7.85\times10^{-4}$ N and the x-axis, that is, the ratio ($S_{1a}/S_{2a}$) is 1.5 to 3.5.

3. The process for preparing a toner according to claim 2, wherein, when the number average particle size of the toner is represented by $D1_T$ (μm), in a particle size (x-axis)-strain (y-axis) curve (R-$A_{80}$ curve) obtained in the micro compression test, a change rate φ (%) between $B^{10}$(%), which is a strain value corresponding to $D1_T$, and $A_{80a}$, [$\phi=(A_{80a}-B_{10})\times100/B_{10}$] is 15.0% or less; and assuming that a strain value corresponding to a particle size which is 1.2 times $D1_T$ is represented by $B_{12}$(%) and a strain value corresponding to a particle size which is 0.8 times $D1_T$ is represented by $B_{08}$(%), the inclination α of $B_{12}$ and $B_{08}$, that is, [$\alpha=(B_{12}-B_{08})/(D1_T\times0.4)$] is −15.0 or less.

4. The process for preparing a toner according to claim 2, wherein, in a particle size (x-axis)-inflection point (y-axis) curve (R-C curve) obtained in the micro compression test, when a value of inflection point C corresponding to $D1_T$ is represented by $C_{10}$(N), $C_{10}$ falls within the range of $9.81\times10^{-5}$ to $3.43\times10^{-4}$ N (10.00 to 35.00 mgf); and assuming that a value of inflection point C corresponding to a particle size which is 1.2 times $D1_T$ is represented by $C_{12}$(N) and a value of inflection point C corresponding to a particle size which is 0.8 times $D1_T$ is represented by $C_{08}$(N), the inclination β of $C_{12}$ and $C_{08}$, [$\beta=(C_{12}-C_{08})/(D1_T\times0.4)$] is 15.0 or less.

5. The process for preparing a toner according to claim 2, wherein, in a load (x-axis)-strain (y-axis) curve obtained in the micro compression test of the toner at $T_1$+5 (° C.), when an area of a region which is surrounded by the curve, a linear line of $x=7.85\times10^{-4}$N and the x-axis is represented by $S_{1b}$ and an area of a region which is surrounded by a linear line connecting a point on the curve at a load of $3.92\times10^{-5}$ N to a point on the curve at a load of $7.85\times10^{-5}$ N, a linear line of $x=7.85\times10^{-4}$ N and the x-axis is represented by $S_{2b}$, the ratio of $S_{1b}$ and $S_{1a}$, ($S_{1b}/S_{1a}$), is 1.2 to 3.0 and the ratio of $S_{2b}$ and $S_{2a}$, ($S_{2b}/S_{2a}$), is 2.0 to 6.0.

6. The process for preparing a toner according to claim 2, wherein the toner particles contains at least wax and a colorant and have a core-shell structure having a core phase containing a binder resin as a main component and a shell phase containing a surface-layer resin as a main component and covering the core phase.

7. The process for preparing a toner according to claim 6, wherein the toner contains the surface-layer resin in an amount of 1.0 to 10.0 parts by mass relative to 100.0 parts by mass of a core particles; the surface-layer resin has, in a loss tangent (tan δ) curve obtained in a dynamic viscoelasticity test, a maximum value of tan δ at a temperature $T_s$ (° C.) within a range of 45.0 to 85.0° C. and, in a storage elastic modulus (G') curve obtained in the dynamic viscoelasticity test, a value of G' ($G'_{10}$) at a temperature of $T_s$+10 (° C.), of $1.0\times10^5$ to $5.0\times10^6$ Pa and a value of G' ($G'_{30}$) at a temperature of $T_s$+30 (° C.), of $1.0\times10^4$ to $5.0\times10^5$ Pa.

8. A process for preparing a toner comprising the steps of:

(a) preparing toner particles each of which contains at least a binder resin, a colorant, and a wax, and has a coat layer on the surface thereof; and (b) adding an inorganic fine powder to the toner particles, wherein the step (a) comprises:

(i) providing an aqueous medium containing a color particle and a sparingly water-soluble inorganic salt, both of which are dispersed therein, the color particle containing at least the binder resin, the colorant, and the wax;

(ii) forming a dispersion solution mixture by adding a resin microparticle to the aqueous medium; and (iii) immobilizing the resin microparticle to the color particle by:

heating the dispersion solution mixture to a temperature of not less than $T_2$ (° C.) and not more than $T_s$ (° C.), where $T_2$ (° C.) is the glass transition point of the color particle and $T_s$ (° C.) is the glass transition point of the resin microparticle;

adjusting a pH of the dispersion solution mixture to 5.0 or less to dissolve the sparingly water-soluble inorganic salt; and then heating the dispersion solution mixture to a temperature of not less than $T_2$ (° C.) and not more than $T_s$−30 (° C.) to $T_s$ (° C.) or less, wherein the resin microparticle has a volume average particle size of 20.0 to 100.0 nm, wherein the resin microparticle has a zeta potential ($Z_{1s}$) of from −110.0 mV to −35.0 mV, and wherein the color particle has a zeta potential ($Z_{2c}$) of −15.0 mV or less, the zeta potential ($Z_{2c}$) satisfying the relationship: ($Z_{1s}$+5.0) to ($Z_{1s}$+50.0) mV.

9. A process for preparing a toner comprising the steps of:

(a) preparing toner particles each of which contains at least a binder resin, a colorant, and a wax, and has a coat layer on the surface thereof; and (b) adding an inorganic fine powder to the toner particles, wherein the step (a) comprises:

(i) providing a resin microparticle having a volume average particle size of 20.0 to 100.0 nm, and having a zeta potential ($Z_{1s}$) of from −110.0 mV to −35.0 mV;

(ii) providing an aqueous medium containing a color particle and a sparingly water-soluble inorganic salt, in which the sparingly water-soluble inorganic salt is adsorbed to the color particle, wherein the color particle contains at least the binder resin, the colorant, and the wax, and has a zeta potential ($Z_{2c}$) of −15.0 mV or less, the zeta potential ($Z_{2c}$) satisfying the relationship: ($Z_{1s}$+5.0) to ($Z_{1s}$+50.0) mV;

(iii) forming a dispersion solution mixture by adding the resin microparticle to the aqueous medium; and (iv) immobilizing the resin microparticle to the color particle by:

heating the dispersion solution mixture to a temperature of not less than $T_2$ (° C.) and not more than $T_s$ (° C.), where $T_2$ (° C.) is the glass transition point of the color particle and $T_s$ (° C.) is the glass transition point of the resin microparticle;

adjusting a pH of the dispersion solution mixture to 5.0 or less to dissolve the sparingly water-soluble inorganic salt; and then heating the dispersion solution mixture to a temperature of not less than $T_2$ (° C.) and not more than $T_s$−30 (° C.) to $T_s$ (° C.) or less.

10. A process for preparing a toner comprising the steps of:

(a) preparing toner particles each of which contains at least a binder resin, a colorant, and a wax, and has a coat layer on the surface thereof; and (b) adding an inorganic fine powder to the toner particles, wherein the step (a) comprises:

(i) providing a resin microparticle having a volume average particle size of 20.0 to 100.0 nm, and having a zeta potential ($Z_{1s}$) of from −110.0 mV to −35.0 mV;

(ii) providing an aqueous medium containing a color particle and a sparingly water-soluble inorganic salt, in which the sparingly water-soluble inorganic salt is adsorbed to the color particle, wherein the color particle contains at least the binder resin, the colorant, and the wax, and has a zeta potential ($Z_{2c}$) of −15.0 mV or less, the zeta potential ($Z_{2c}$) satisfying the relationship: ($Z_{1s}$+5.0) to ($Z_{1s}$+50.0) mV;

(iii) forming a dispersion solution mixture by adding the resin microparticle to the aqueous medium and interacting the resin microparticle with the sparingly water-soluble inorganic salt adsorbed on the surface of the color particle; and (iv) immobilizing the resin microparticle to the color particle by:

heating the dispersion solution mixture to a temperature of not less than $T_2$ (° C.) and not more than $T_s$ (° C.), where $T_2$ (° C.) is the glass transition point of the color particle and Ts (° C.) is the glass transition point of the resin microparticle;

adjusting a pH of the dispersion solution mixture to 5.0 or less to dissolve the sparingly water-soluble inorganic salt; and then heating the dispersion solution mixture to a temperature of not less than $T_2$ (° C.) and not more than $T_s$−30 (° C.) to $T_s$ (° C.) or less.

* * * * *